US007427257B1

(12) United States Patent
Chernet

(10) Patent No.: US 7,427,257 B1
(45) Date of Patent: Sep. 23, 2008

(54) MULTI-PARTY MULTI-PURPOSE FITNESS MACHINE

(76) Inventor: Ayele Chernet, 2751 Wayfaring La., Unit B, Lisle, IL (US) 60532

( * ) Notice: Subject to any disclaimer, the term of this patent is extended or adjusted under 35 U.S.C. 154(b) by 0 days.

(21) Appl. No.: 11/398,804

(22) Filed: Apr. 5, 2006

Related U.S. Application Data

(60) Provisional application No. 60/670,765, filed on Apr. 13, 2005.

(51) Int. Cl.
*A63B 26/00* (2006.01)

(52) U.S. Cl. ..... 482/142; 482/95

(58) Field of Classification Search ..... 482/92–100, 482/142, 148
See application file for complete search history.

(56) References Cited

U.S. PATENT DOCUMENTS 4,390,179 A * 6/1983 Szkalak ..... 482/100
4,744,559 A * 5/1988 Mahnke et al. ..... 482/99
D456,862 S * 5/2002 Webber ..... D21/675
7,316,634 B2 * 1/2008 Webber ..... 482/93

OTHER PUBLICATIONS

Dual Action Electronic Exercise Cycle, Owner's Manual, Formula Ventures, Nov. 22, 1989.
Healyhmax 30 x 3 Total Fitness Workout, Brochure, Healthma, 1993.
Life Styler AB/Back 100, Owner's Manual Stamina Products, Inc. Jun. 2000.
Kettler Power Stepper, Brochure Printed From Internet, Apr. 4, 2006.

* cited by examiner

*Primary Examiner*—Lori Amerson

(57) ABSTRACT

A multi-party, multi-purpose and collapsible fitness machine comprising an upper body workout unit, a leg curl/extension workout unit, a leg press workout unit and a cardiovascular workout unit with all the units being structured and combined to work cooperatively to enable three or more users to simultaneously exercise and strengthen various muscles of their bodies.

5 Claims, 32 Drawing Sheets

MULTI-PARTY MULTI-PURPOSE FITNESS MACHINE

CROSS-REFERENCE TO RELATED APPLICATIONS

This application claims the benefit of Provisional Patent Application Ser. No. U.S. 60/670,765, filed 2005 Apr. 13 by the present inventor.

BACKGROUND OF THE INVENTION

1. Field of the Invention

This invention relates to a multi-party, multi-purpose and collapsible fitness machine geared towards usage by three or more persons simultaneously performing various types of muscle building and toning as well as cardiovascular exercises.

2. Discussion of Prior Art

It is a well documented fact that there exist multitudes of exercise apparatus which in unison or individually can be used to perform various types of muscle building and toning as well as cardiovascular exercises. However, acquiring a selection of a multitude of individual exercise apparatus to perform all types of exercises requires a lot of floor space and a lot of money. This is beyond the means of most users of exercise machines. The multi-party, multi-purpose fitness machine is designed with this in mind and is geared towards the family unit where members of a family can work out together simultaneously on one simple efficient machine offering a wide range of exercises for building and toning various muscles of the body as well as for performing cardiovascular exercises to condition the heart. This invention advocates that a family that works out together stays fit and united forever.

If one were to examine many of the brochures and infomercials for fitness machines and if one were to visit sporting equipment outlets as well as most gyms, one would find that most multi-station exercise apparatus available on the market today are complicated as they all invariably use a set of complex cable and pulley systems for generating forces and securing variable weights to provide resistance. This complexity makes such fitness machines difficult to manufacture, set up and maintain and quite expensive as a result. In the present invention, the design bypasses this approach thereby completely eliminating the need for cables and pulleys. This in turn translates into reduced cost for manufacturing, set up and maintenance thus making the present invention much more affordable.

Most multi-station fitness machines require large floor areas and bigger headroom as a result of their complex makeup. This limits their acceptance by many users who cannot spare prime floor areas for such machines as gym space utilization efficiency (GSUE) of such machines gets excessively high. Gym space utilization efficiency or GSUE as it applies to multi-station fitness machines having capabilities for a variety of exercises is the ratio of the projected floor area occupied by such fitness machine divided by the maximum number of simultaneous users. For instance, if a multi-station fitness equipment occupies a projected floor area of 7 feet by 8 feet (56 sq. ft.) and a maximum of two people can use the equipment simultaneously, the GSUE then becomes 28 sq. ft. per user. If on the other hand, the multi-station fitness equipment can only be used by one person at any given time, the GSUE becomes 56 sq. ft. per person which basically limits the cost effectiveness of such multi-station fitness machine. My present invention occupies a projected floor area of approximately 6 ft. by 9 ft (54 sq. ft.) under maximum usage. It has capability for over thirty different exercises. It is designed to accommodate three or more users working on it simultaneously. A maximum of five users can work on it at the same time which gives it a GSUE of 11 sq. ft. per user thus ranking it among the top cost effective fitness machines to own.

Most multi-station exercise machines are not built for simultaneous use by multiple users. The fact that a fitness machine is multi-station does not necessarily translate into multi-usage where three or more people can simultaneously work on it. The multi-station capability is only for the variety of exercises that one individual can perform on the machine at any given time by changing the type of exercise to develop a specific set of muscles. Most do not have the capability for three or more people to simultaneously work out on the same machine. As explained above, the present invention is specifically designed to accommodate three or more users and as many as five users working on it simultaneously.

Most multi-station exercise machines are geared towards building and toning the different superficial muscles of the body with no accommodation for cardiovascular exercises to benefit the heart. This invention combines a stepper mechanism to simulate stair climbing for purposes of cardiovascular workout.

Most multi-station fitness machines are not built to be collapsible in some form to reduce the projected floor area they occupy when they are not being used. The present invention is designed to be collapsible. This gives the present invention the capability to be placed in a small room where it can interchangeably share floor space with other small furniture. During exercise session, the small furniture can be moved out of the way temporarily allowing the fitness machine to be unfolded and/or extended into the freed space. When the exercise session is over, the machine is retracted and/or folded back for stowage thus freeing up needed space for the furniture.

Most multi-station fitness machines have limited capability for the user to change the positions of the levers to suit his/her physical stature to comfortably perform the various exercises. The present invention has flexibility built into it whereby adjustments in the force application levers and resistance mechanisms can be made with minimal effort to suit the specific needs and physical stature of the user. Short, tall, small or big people can use the machine without being encumbered.

SUMMARY OF THE INVENTION

In the present invention, a fitness machine comprises upper body workout unit, leg curl/extension workout unit, leg press workout unit and cardiovascular workout unit with all the units being structured and combined to form a complete fitness machine to enable three or more users to exercise simultaneously to build and tone various muscles of their bodies.

BRIEF DESCRIPTION OF THE DRAWINGS

The list of drawings with their brief descriptions is as follows.

Figure 1A:
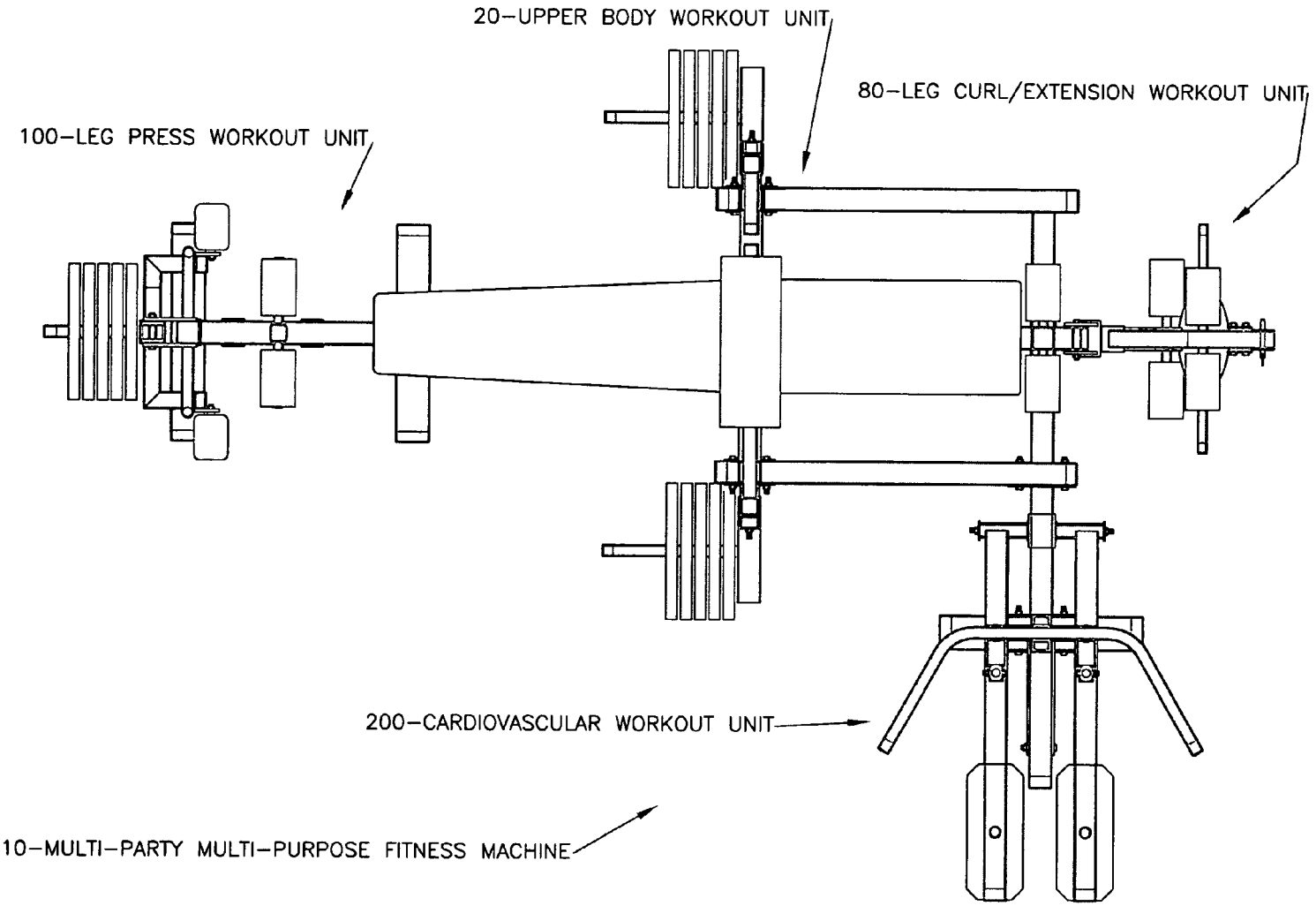
FIG. 1A shows top view of the multi-party multi-purpose fitness machine in fully extended operational mode.

The list for the parts noted in the drawings is as follows:

10 Multi-Party Multi-Purpose Fitness Machine
20 Upper Body Workout unit
21 left horizontal tube
21A bushing
21B bushing
21C a pair of parallel through holes
22 bottom horizontal tube
22A a pair of parallel through holes
23 right horizontal tube
23A bushing
23B bushing
23C a pair of parallel through holes
23D a pair of parallel through holes
24 connection location
25 connection location
27L a set of four left fasteners
27R a set of four right fasteners
27C a set of four center fasteners
28 right upright tube
28A bushing
28B a pair of parallel through holes
28C a single through hole
29 left upright tube
29A bushing
29B a pair of parallel through holes
29C a single through hole
30 top horizontal tube
30A a pair of parallel through holes
31L left round pivot bar
31R right round pivot bar
32 connection location
32A locknut
32B load bearing bushing
32C washer
32D washer
33 connection location
33A locknut
33B load bearing bushing
33C washer
33D washer
34A a single through hole
34B a single through hole
34C pipe sleeve
34D pipe sleeve
34E a single through hole
34F a single through hole

34L left pivot frame upright tube
34R right pivot frame upright tube
35L left triangular connector plate
35R right triangular connector plate
36L left triangular connector plate
36R right triangular connector plate
37L left triangular connector plate
37R right triangular connector plate
38 right bracing bar
38A self-tapping fastener
38B self-tapping fastener
39 left bracing bar
39A self-tapping fastener
39B self-tapping fastener
40 right knee brace bar
40A connection location
40B connection location
41 left knee brace bar
41A connection location
41B connection location
43 upright tube
43A a pair of parallel through holes
43B L-shaped bent plate
43C connection location
44 longitudinal tube
44A bushing
44B a single through hole
44C a single through hole
44D a single thru hole
44E removable handle
44F bushing
44G bushing
44H hollow cylinder
44J bushing
44K bushing
44L cylindrical cushion
44M cylindrical cushion
44N pipe sleeve
45 connection location
46 connector plate
47 connector plate
47A self-tapping fastener
48 connector plate
48A self-tapping fastener
49 seat of uniform width
49A seat base
49B seat cushion
49C seat cover
50A connection location
50B connection location
50C bushing
50D bushing
50L tube
50R tube
51A connection location
51B connection location
51C bushing
51D bushing
51L hollow cylinder
51R hollow cylinder
52L a set of free weights
52R a set of free weights
53L stop bar
53R stop bar
54L tubular bushing
54R tubular bushing
55A bushing
55B bushing
55L left telescoping arrn upright tube
55R right telescoping arrn upright tube
56L a set of equally spaced parallel through holes
56R a set of equally spaced parallel through holes
57L lock pin
57R lock pin
58A connection location
58B cylindrical cushion
58C connection location
58D bushing
58E bushing
58L hollow cylinder
58R hollow cylinder
80 Leg Curl/Extension Workout unit
81 upright tube
81A a pair of parallel through holes
81B bushing
81C a single through hole
82 hollow cylinder
82A bushing
82B connection location
83 a set of free weights
84 hollow cylinder
84A bushing
84B connection location
85 cap plate
86A plate with an opening
86B plate with an opening
86C fastener
87 hollow cylinder
87A cylindrical cushion
87B cylindrical cushion
87C bushing
87D bushing
88 horizontal tube
88A bushing
88B a single through hole
89 U-shaped bent plate
89A a set of two fasteners
90 upright tube
90A a single through hole
90B bushing
90C a single through hole
91A plate with an opening
91B plate with an opening
91C lock pin
92 hollow cylinder
92A cylindrical cushion
92B cylindrical cushion
92C bushing
92D bushing
93A linkage bar
93B linkage bar
93C fastener
93D fastener
93E a set of two spacers
93F a set of two spacers
100 Leg Press Workout unit
101 upright tube
101A bushing
101B a pair of parallel through holes
101C plate with an opening
101D plate with an opening
101F U-shaped hollow cylinder
101G U-shaped hollow cylinder
101H bushing

101J bushing
102 horizontal tube
102A bushing
102B bushing
102C a pair of parallel through holes
102D roller/glider
102E roller/glider
103 connection location
104 upright tube
104A L-shaped bent plate
104B fastener
105 horizontal tube
105A bushing
105B bushing
105C a pair of parallel through holes
105D roller/glider
105E roller/glider
106 connection location
107 U-shaped bent plate
108 horizontal tube
108A connector plate
108B connector plate
109A a set of two fasteners
109B a set of two fasteners
110 upright tube
110A bushing
110B connection location
111 hollow cylinder
111A bushing
111B bushing
111C cylindrical cushion
111D cylindrical cushion
112 horizontal tube
112A bushing
112B a pair of parallel through holes
113 U-shaped bent plate
113A a set of two fasteners
113B a set of two fasteners
114A guide plate
114B guide plate
114C guide plate
114D guide plate
115 longitudinal tube
115A stop angle
115B stop angle
115C connector plate
115D bushing
115E a set of equally spaced parallel through holes
115F a single through hole
116A glider disc
116B glider disc
117 seat of variable width
117A seat base of variable width
117B seat cushion
117C seat cover
118 connector plate
118A self-tapping fasteners
119 connector plate
119A self-tapping fasteners
120 connector plate
120A self-tapping fasteners
121 angle member
122 U-shaped bent plate
122A lock pin
130 upright tube
130A bushing
130B through hole
130C cap plate
131 hollow cylinder
131A bushing
131B bushing
132A plate with an opening
132B plate with an opening
133 pipe sleeve
135 a set of free weights
136A tube
136B tube
137A tube
137B tube
137C connection location
137D connection location
137E bushing
137F bushing
138A plate with an opening
138B plate with an opening
200 Cardiovascular Workout Unit
201 upright tube
201A a pair of parallel through holes
201B a single through hole
201C a single through hole
202 horizontal tube
202A bushing
202B bushing
202C a pair of parallel through holes
202D a set of two fasteners
203 connection location
204 horizontal tube
204A connector plate
204B bushing
204C a single through hole
205 horizontal tube
205A connector plate
205B connector plate
205C a set of two fasteners
206A flat bracing bar
206B flat bracing bar
206C fastener
206D fastener
206E spacer
206F spacer
207 U-shaped bent plate
208 round pivot bar
208A locknut
208B locknut
209A stepper rube
209B stepper tube
209C connection location
209D bushing
210A stepper tube
210B stepper tube
210C connection location
210D bushing
211A foot rest plate
211B foot rest plate
212A non-skid pad
212B non-skid pad
213A hollow cylinder
213B bushing
213C hollow cylinder
213D bushing
214A U-shaped bent plate
214B U-shaped bent plate
214C fastener
214D fastener

215A hydraulic cylinder
215B hydraulic cylinder
216A pipe sleeve
216B pipe sleeve
217A washer
217B washer
218A washer
218B washer
219 hollow cylinder
219A bushing
219B bushing
220A plate with an opening
220B plate with an opening
221A plate with an opening
221B plate with an opening
222A fastener
222B fastener
223 hollow cylinder handle
223A bushing
223B bushing
223C connection location
224 upright tube
225 U-shaped bent plate
226 a set of two fasteners

DETAILED DESCRIPTION OF THE INVENTION

The fitness machine 10 as shown in FIGS. 1A, 1B, 1C, 1D and 1E comprises of an upper body workout unit 20, a leg curl/extension workout unit 80, a leg press workout unit 100 and a cardiovascular workout unit 200.

1. Detailed Description of the Upper Body Workout Unit 20

Figure 2:
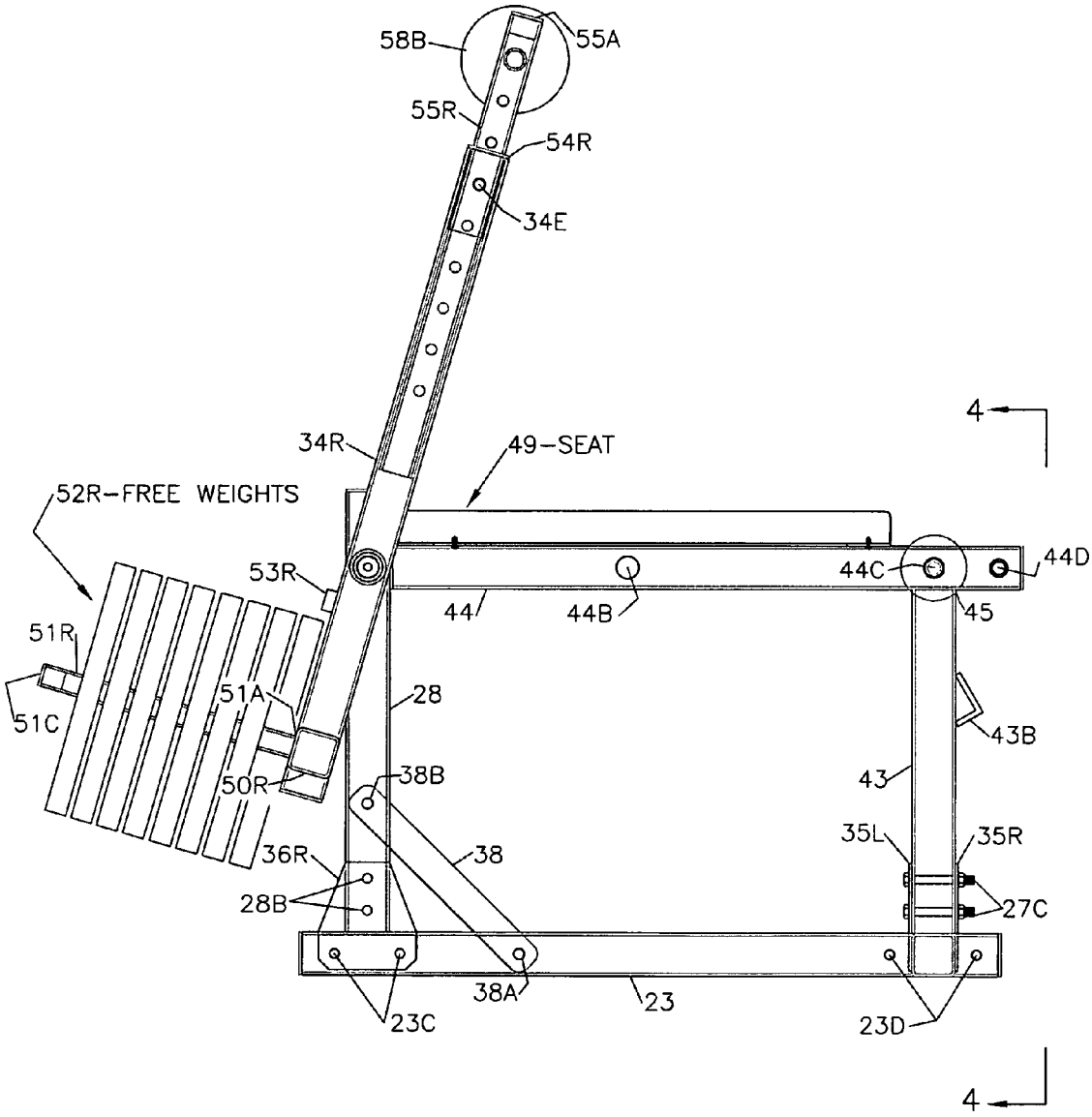
FIG. 2 shows right side elevation of the upper body workout unit.

The design and construction of unit 20 being modular, its components will be described in detail starting from the base module and moving upward. FIG. 2 shows the right side elevation of unit 20. FIGS. 3, 3A, 3B, 3C and 3D show details of the support base module. The support base is comprised of two oppositely disposed parallel horizontal tubes 21 and 23 transversely connected adjacent their distal ends to a third horizontal tube 22 at locations 24 and 25 respectively. Tube 21 has a bushing 21A at its proximal end, a second bushing 21B at its distal end and a pair of parallel transverse through holes 21C adjacent its proximal end. Tube 22 has a pair of parallel transverse through holes 22A centered on its lengthwise center location. Tube 23 has a bushing 23A at its proximal end, a second bushing 23B at its distal end and a pair of parallel transverse through holes 23C and 23D adjacent its proximal and distal ends respectively.

Figure 4:
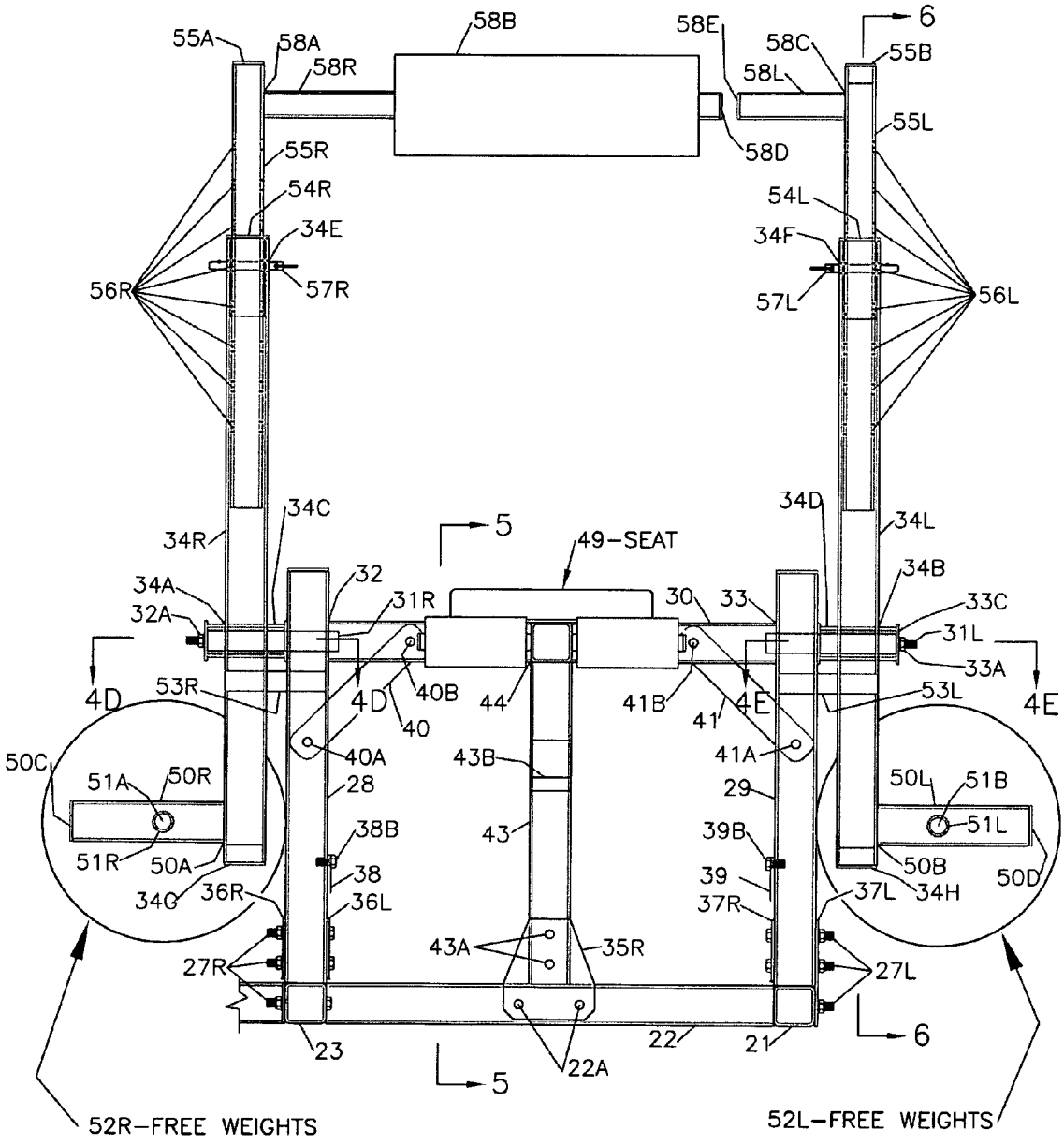
FIG. 4 shows the front view of the upper body workout unit.
Figure 4B:
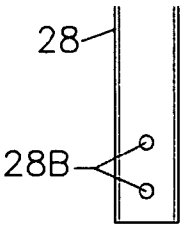
FIG. 4B shows a sectional view of a portion of the rear support module for the upper body workout unit.
Figure 4C:
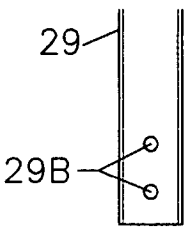
FIG. 4C shows a sectional view of a portion of the rear support module for the upper body workout unit.
Figure 4A:
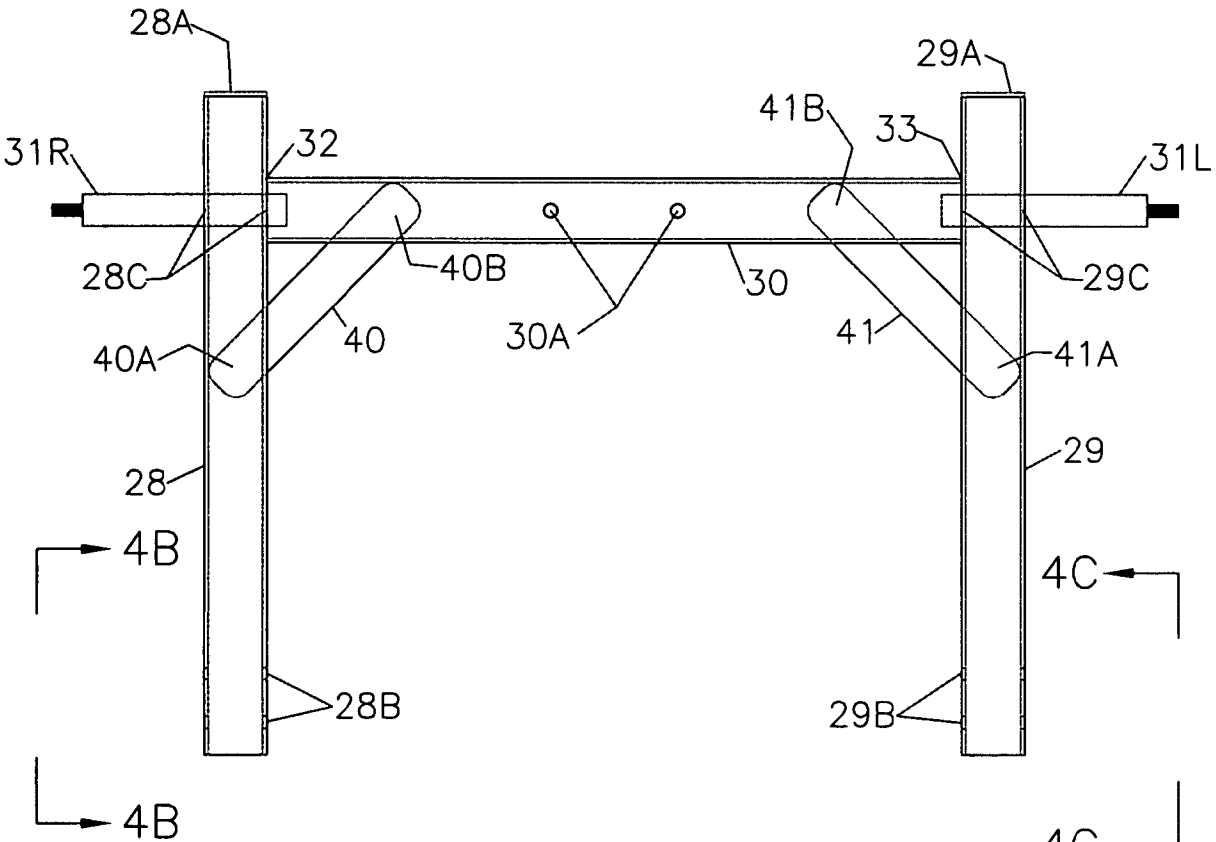
FIG. 4A shows the rear support frame module for the upper body workout unit.

FIGS. 4A, 4B and 4C show the details of the rear support frame module. The rear support is comprised of a pair of oppositely disposed parallel upright tubes 28 and 29 transversely connected adjacent their top ends to a top horizontal tube 30 at locations 32 and 33 respectively. Upright tube 28 has a bushing 28A at its top end, a pair of parallel transverse through holes 28B adjacent its bottom end and a single transverse through hole 28C adjacent its top end in line with the horizontal axis of tube 30. Upright tube 29 has a bushing 29A at its top end, a pair of parallel transverse through holes 29B adjacent its bottom end and a single transverse through hole 29C adjacent its top end in line with hole 28C of upright tube 28. Horizontal tube 30 has a pair of parallel transverse through holes 30A centered on its lengthwise center location. A round pivot bar 31R having its distal end machined and threaded is inserted into hole 28C of upright tube 28 and affixed in place extending outwards there from and with its proximal end embedded inside one end of horizontal tube 30. An identical round pivot bar 31L having its distal end machined and threaded is inserted into hole 29C of upright tube 29 and affixed in place extending outwards there from and with its proximal end embedded inside the opposite end of horizontal tube 30. A flat lateral bracing bar 40 is connected to upright tube 28 and to horizontal tube 30 at locations 40A and 40B respectively with a preferred angle of disposition. A second oppositely disposed flat lateral bracing bar 41 is connected to upright tube 29 and to horizontal tube 30 at locations 41A and 41B respectively with the same preferred angle of disposition.

Figure 5:
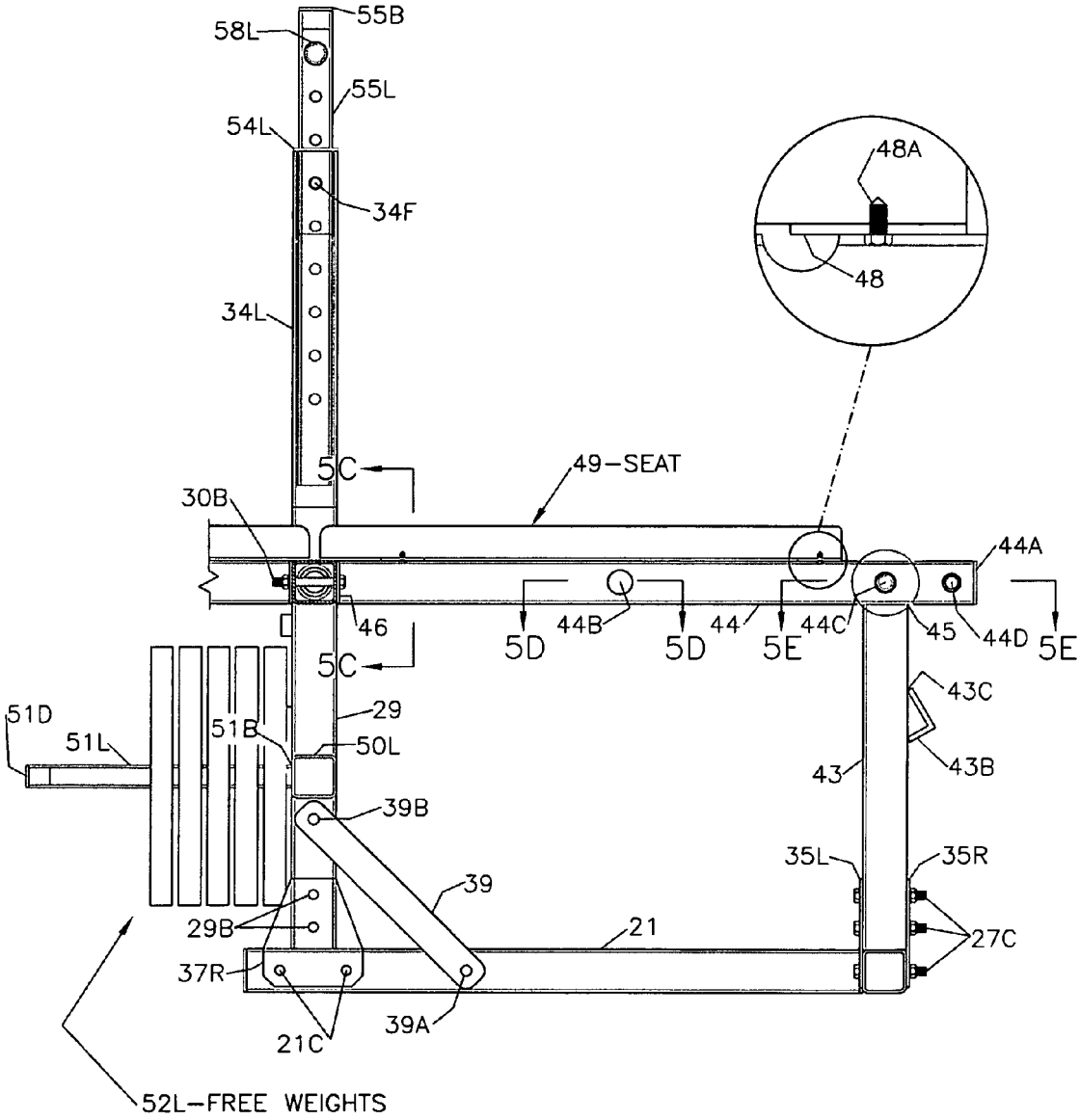
FIG. 5 shows a sectional right side view of the upper body workout unit.
Figures 5A, 5B:
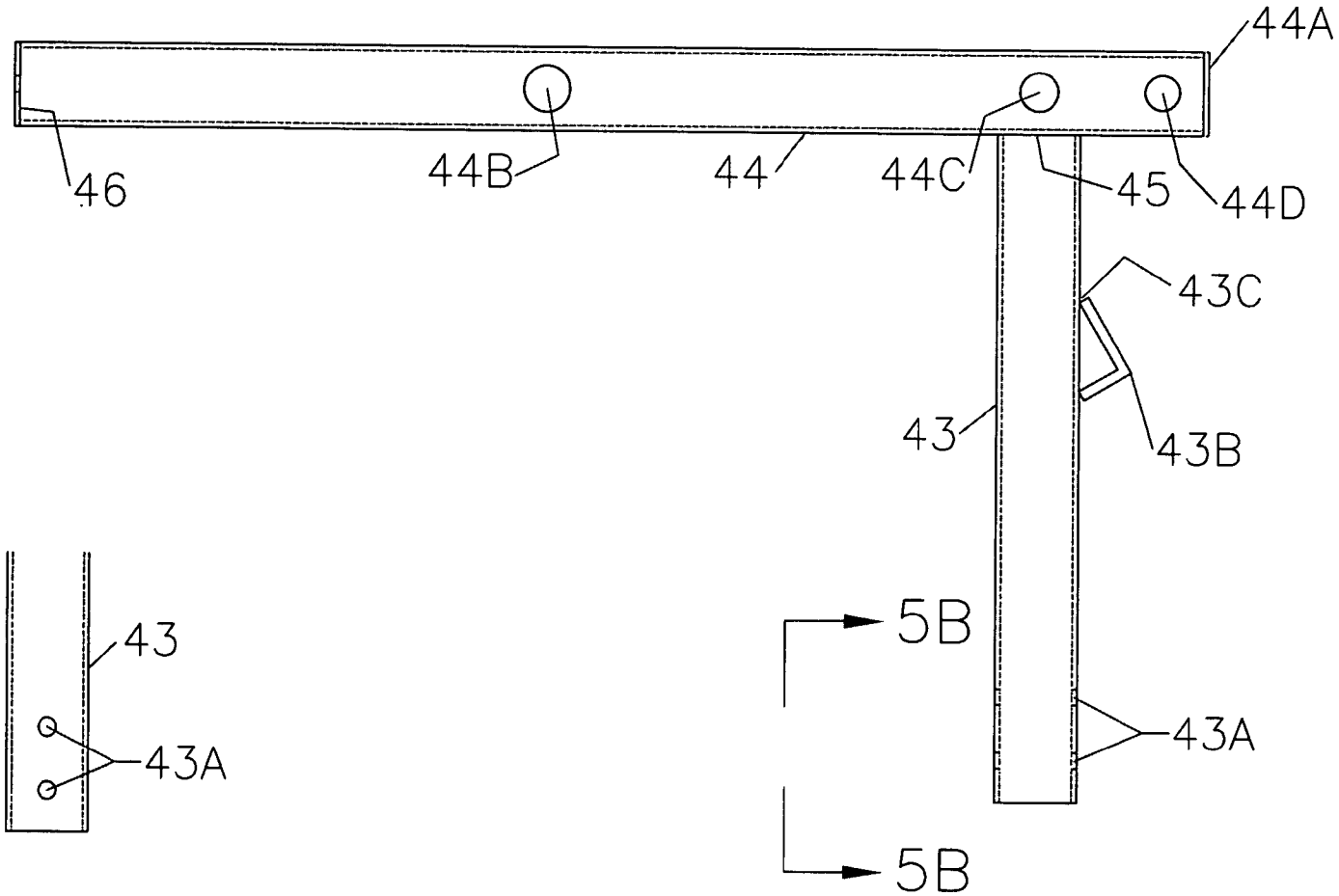
FIG. 5A shows the right side elevation of the seat frame module for the upper body workout unit.
FIG. 5B shows a sectional view of a portion the seat frame module for the upper body workout unit.

FIGS. 5, 5A and 5B show details of the seat support frame module. The seat support frame is comprised of a longitudinal tube 44 cantilevered over an upright tube 43 and affixed to the top of tube 43 at location 45. Longitudinal tube 44 has a bushing 44A at its distal end and a rectangular plate 46 affixed to its proximal end. The rectangular plate 46 is provided with oppositely disposed openings which match in size and are aligned with the pair of through holes 30A at the lengthwise center location of horizontal tube 30 of the rear support frame (FIG. 4). Tube 44 is provided with three parallel transverse through holes 44B, 44C and 44D. Hole 44B is located adjacent the lengthwise center location of tube 44. Hole 44C is located immediately above location 45 while hole 44D is located adjacent the distal end of tube 44. Upright tube 43 has a pair of transverse through holes 43A adjacent its bottom end and a bent plate 43B affixed to its outward face at location 43C.

With reference to FIGS. 2, 4 and 5 which show various views of the assembled unit 20, upright tubes 28 and 29 are positioned on top of the proximal ends of horizontal tubes 23 and 21 respectively such that holes 28B and 29B adjacent the bottom ends of upright tubes 28 and 29 are centered on holes 23C and 21C adjacent the proximal ends of horizontal tubes 23 and 21 respectively. Upright tube 43 is positioned on top of horizontal tube 22 such that holes 43A adjacent the bottom end of tube 43 are centered on holes 22A of tube 22. Two identical triangular connector plates 36R and 36L each having four openings are oppositely disposed on either side of the proximal end of tube 23. Plates 36R and 36L are placed such that the bottom two openings of the plates are aligned with holes 23C in tube 23 and the top two openings are aligned with holes 28B in upright tube 28. A set of four fasteners 27R is installed to affix plates 36R and 36L to the bottom end of upright tube 28 and to the proximal end of tube 23. In a similar manner, two identical triangular connector plates 37R and 37L each having four openings are oppositely disposed on either side of the proximal end of tube 21. Plates 37R and 37L are placed such that the bottom two openings of the plates are aligned with holes 21C in tube 21 and the top two openings are aligned with holes 29B in upright tube 29. A set of four fasteners 27L is installed to affix connector plates 37R and 37L to the bottom end of upright tube 29 and to the proximal end of tube 21. A third set of identical triangular connector plates 35R and 35L each having four openings are oppositely disposed on either side of tube 22 at its lengthwise center location. Plates 35R and 35L are placed such that the bottom two openings of the plates are aligned with holes 22A in tube 22 and the top two openings are aligned with holes 43A in upright tube 43. A set of four fasteners 27C is installed to affix connector plates 35R and 35L to the bottom end of upright tube 43 and to horizontal tube 22 at its lengthwise center location. A flat longitudinal bracing bar 38 with openings at its either end is affixed to horizontal tube 23 and upright tube 28 with self-tapping screws 38A and 38B respectively with a preferred angle of disposition. A second flat longitudinal bracing bar 39 oppositely disposed parallel to bracing bar 38 and having openings at its either end is affixed to horizontal tube 21 and upright tube 29 with self-tapping screws 39A and 39B respectively. Longitudinal tube 44 is affixed to horizontal tube 30 at its lengthwise center location by installing a set of two fasteners 30B after aligning the oppositely disposed openings in rectangular plate 46 with the through holes 30A of tube 30. It is to be noted that it is at this location that the leg press workout unit 100 will be attached to Unit 20 as will be detailed in the specification of unit 100.

Figure 5C:
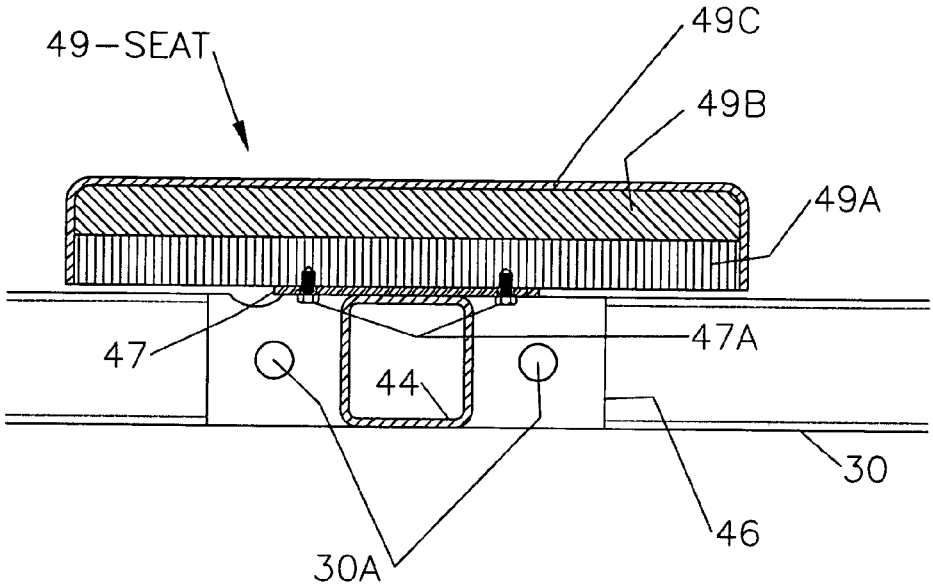
FIG. 5C shows a sectional view of the seat for the upper body workout unit.

With reference to FIGS. 5 and 5C, seat 49 is comprised of a seat base 49A topped by a seat cushion 49B and covered up by seat cover 49C which is affixed to seat base 49A. The seat 49 is supported on two rectangular plates 47 and 48. Plate 47 having a pair of oppositely disposed openings is affixed to top of tube 44 adjacent the proximal end of tube 44. Plate 48 also having a pair of oppositely disposed openings is affixed to top of tube 44 adjacent hole 44C. Seat 49 is attached to plate 47 using a pair of self-tapping screws 47A and to plate 48 using a second pair of self-tapping screws 48A.

Figure 5D:
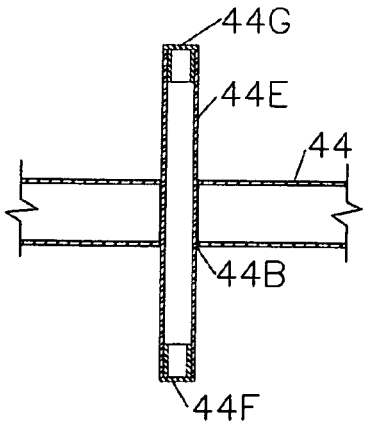
FIG. 5D shows sectional detail of a removable handle for the upper body workout unit.
Figure 5E:
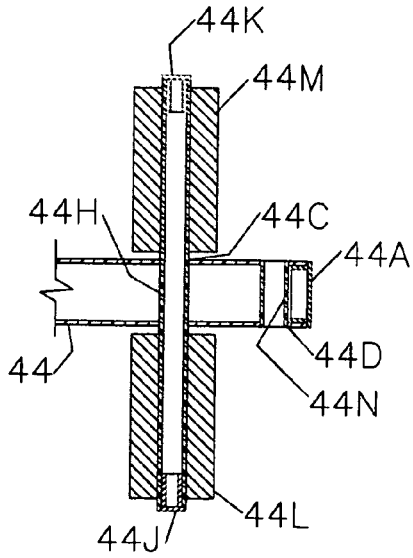
FIG. 5E shows a sectional detail of leg cushion.

With reference to FIGS. 5D and 5E, a removable handle is comprised of a hollow cylinder 44E with a bushing 44F at one end and a second bushing 44G at the opposite end inserted in hole 44B of longitudinal tube 44. A leg cushion is comprised of hollow cylinder 44H having bushings 44J and 44K at its either end. Cylinder 44H is inserted in hole 44C and affixed in place extending outwards there from equally on either side of tube 44. Cylindrical cushions 44L and 44M are fitted over cylinder 44H adjacent its either end. Pipe sleeve 44N having a length equal to width of tube 44 is inserted in hole 44D and affixed in place.

Figure 4E:
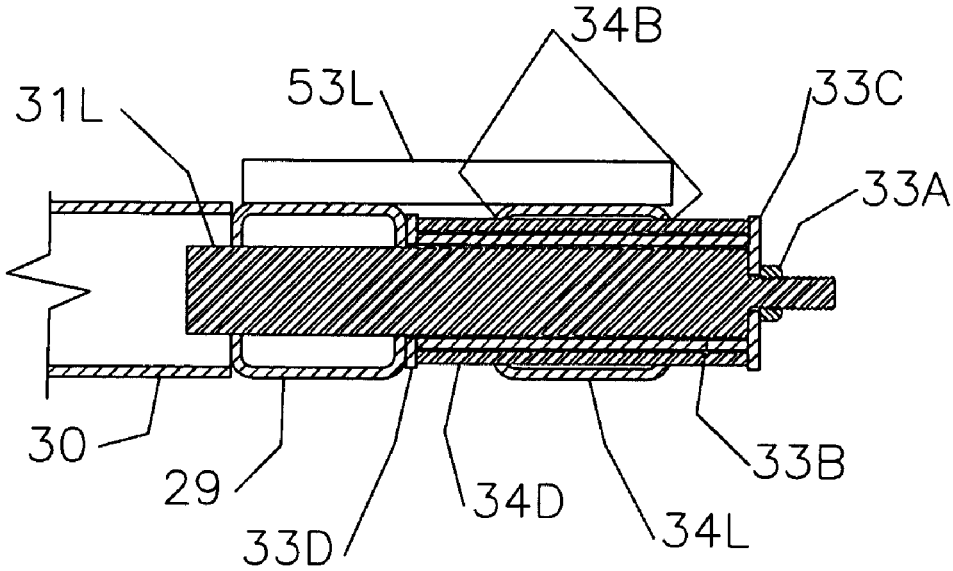
FIG. 4E shows sectional view of a pivot joint detail at the left pivot arm.
Figure 4D:
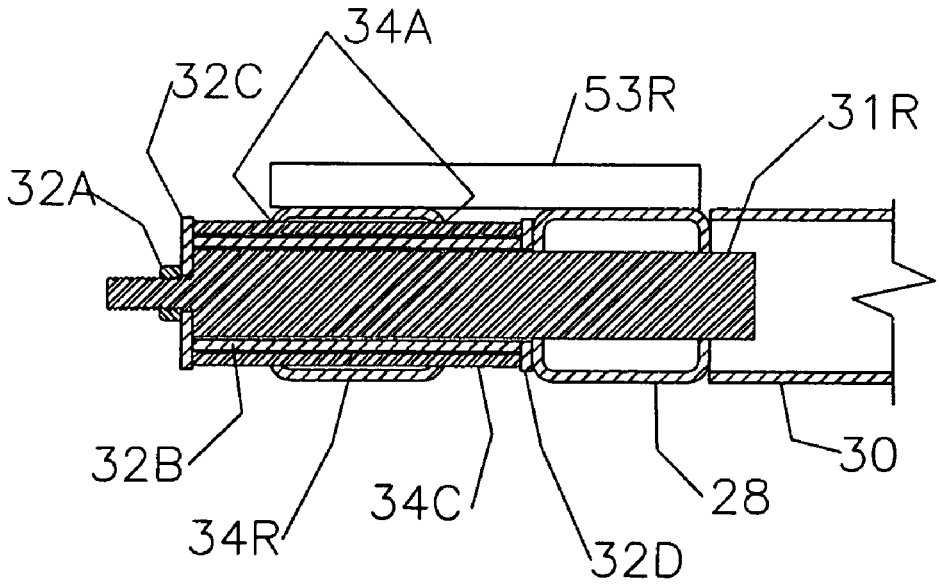
FIG. 4D shows sectional view of a pivot joint detail at the right pivot arm.

With reference to FIGS. 4, 4A, 4D and 4E, a right pivot arm is comprised of an upright tube 34R and a short horizontal tube 50R transversely affixed to tube 34R adjacent its bottom end at location 50A. Tube 34R has bushing 34G at its bottom end, a large transverse through hole 34A at a location a third of its lengthwise distance up from the bottom end and a smaller transverse through hole 34E adjacent its top end. Short tubular bushing 54R having a lip at its top end is inserted into the top end of upright tube 34R. Bushing 54R is provided with a through hole adjacent its top end to match in size and location hole 34E in tube 34R. A pipe sleeve 34C is inserted into hole 34A and affixed in place. Stop bar 53R is affixed to backside of tube 34R adjacent pipe sleeve 34C extending inwards there from such that its free end rests against the backside of upright tube 28 to restrain the bottom portion of tube 34R from rotating in the forward direction. Tube 50R has end plug 50C at its free end. A hollow cylinder 51R with a bushing 51C at its distal end is affixed at its proximal end to tube 50R at location 51A (FIG. 2). Cylinder 51R supports free weights 52R. To mount tube 34R on pivot bar 31R, a single washer 32D is installed first followed by installation of a load bearing bushing 32B over pivot bar 31R. Tube 34R is then mounted on bushing 32B by way of pipe sleeve 34C. The joint assembly is completed by installation of a second washer 32C and a locknut 32A as shown in FIG. 4D. A left pivot arm is comprised of an upright tube 34L and a short horizontal tube 50L transversely affixed to tube 34L adjacent its bottom end at location 50B. Tube 34L has bushing 34H at its bottom end, a large transverse through hole 34B at a location a third of its lengthwise distance up from the bottom end and a smaller transverse through hole 34F adjacent its top end. Short tubular bushing 54L having a lip at its top end is inserted into the top end of upright tube 34L. Bushing 54L is provided with a through hole adjacent its top end to match in size and location hole 34F in tube 34L. A pipe sleeve 34D is inserted into hole 34B and affixed in place. A stop bar 53L is affixed to backside of tube 34L adjacent pipe sleeve 34D extending inwards there from such that its free end rests against the backside of upright tube 29 to restrain the bottom portion of tube 34L from rotating in the forward direction. Tube 50L has bushing 50D at its free end. A hollow cylinder 51L with a bushing 51D at its distal end is affixed at its proximal end to tube 50L at location 51B (FIG. 5). Cylinder 51L supports free weights 52L. To mount tube 34L on pivot bar 31L, a single washer 33D is installed first followed by installation of a load bearing bushing 33B over pivot bar 31L. Tube 34L is then mounted on bushing 33B by way of pipe sleeve 34D. The joint assembly is completed by installation of a second washer 33C and a locknut 33A as shown in FIG. 4E.

Figure 6:
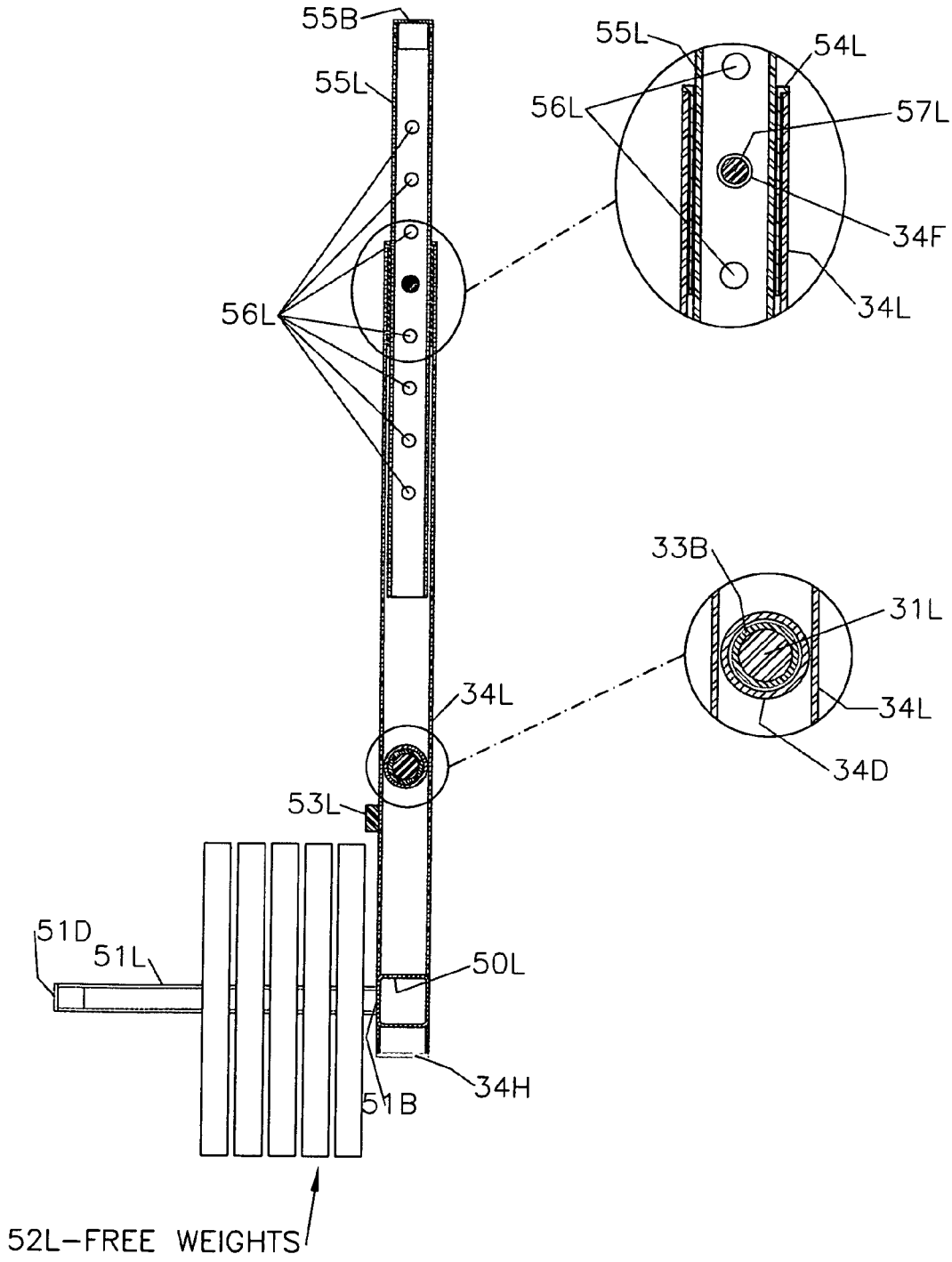
FIG. 6 shows a sectional view of combined pivot and telescoping frames for the upper body workout unit.

With reference to FIGS. 4 and 6, a left telescoping arm is comprised of an upright tube 55L with bushing 55B at its top end and a set of parallel transverse through holes 56L disposed equally spaced along its length. Hollow cylinder 58L with bushing 58E at its distal end is affixed at its proximal end to upright tube 55L at location 58C. Hollow cylinder 58L serves as the handle for the left telescoping arm. Upright tube 55L is inserted into the top end of tube 34L by way of bushing 54L. After adjusting the desired height of the left telescoping arm by aligning any of the set of through holes 56L with the one through hole 34F adjacent the top end of upright tube 34L, lock pin 57L is installed in hole 34F to interlock the left telescoping arm with the left pivot arm. Right telescoping arm is comprised of an upright tube 55R with end plug 55A at its top end and a set of parallel transverse through holes 56R disposed equally spaced along its length. A long hollow cylinder 58R with end plug 58D at its distal end is affixed at its proximal end to upright tube 55R at location 58A. Cylindrical cushion 58B is installed over cylinder 58R adjacent its distal end. Hollow cylinder 58R serves as the handle for the right telescoping arm. Upright tube 55R is inserted into the top end of tube 34R by way of bushing 54R. After adjusting the desired height of the right telescoping arm by aligning any of the set of through holes 56R with the one through hole 34E adjacent the top end of upright tube 34R, lock pin 57R is installed in hole 34E to interlock the right telescoping arm with the right pivot arm. Desired exercises for upper body workout are performed by applying forces at handles 58R and 58L.

Some of the exercises that can be performed on unit 20 include bench press, arm curls, rowing, neck, abdominal and back exercises.

2. Description of the Leg Curl/Extension Workout Unit 80

Figure 2A:
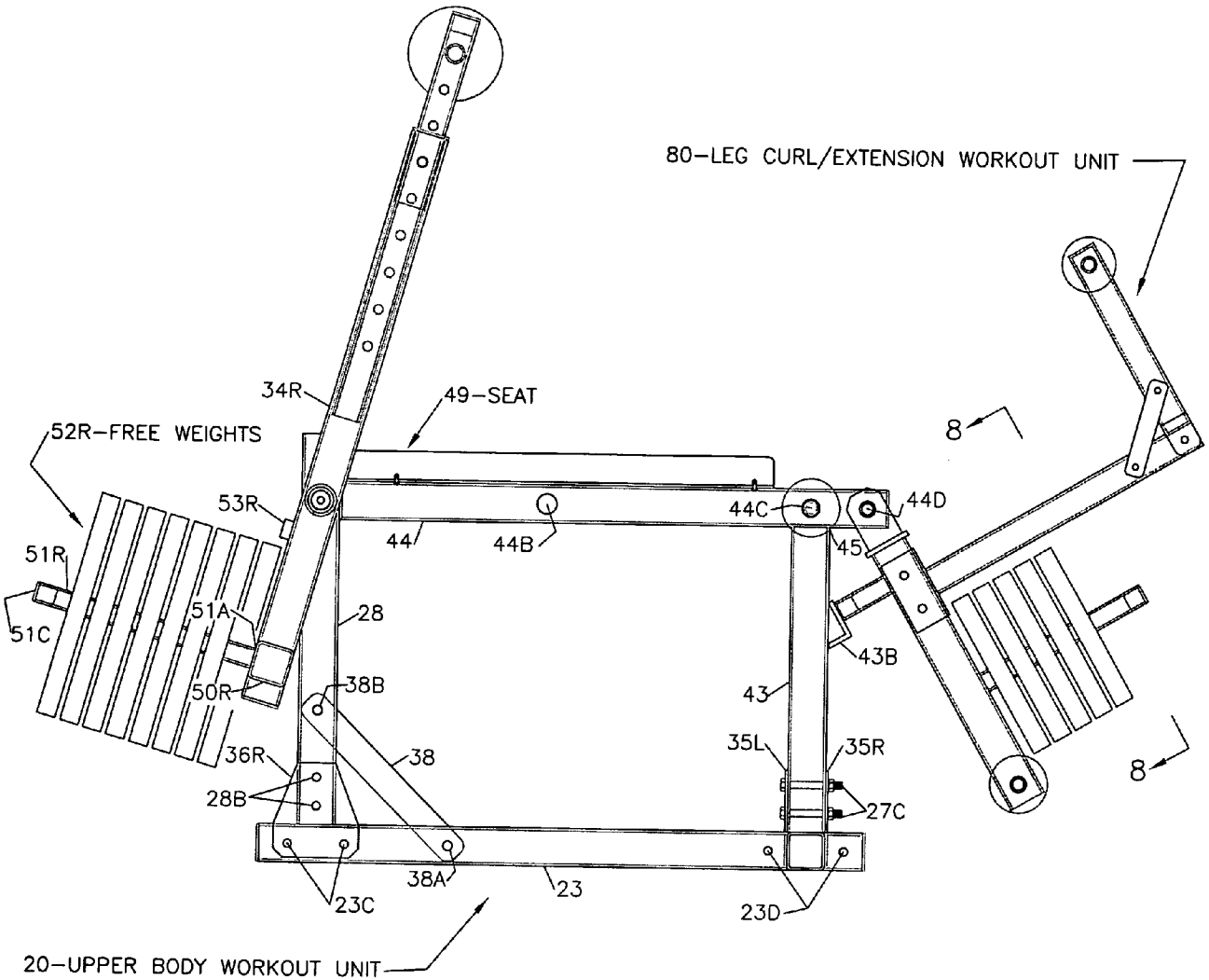
FIG. 2A shows right side elevation of the combined upper body and leg curl/extension workout units.
Figure 3:
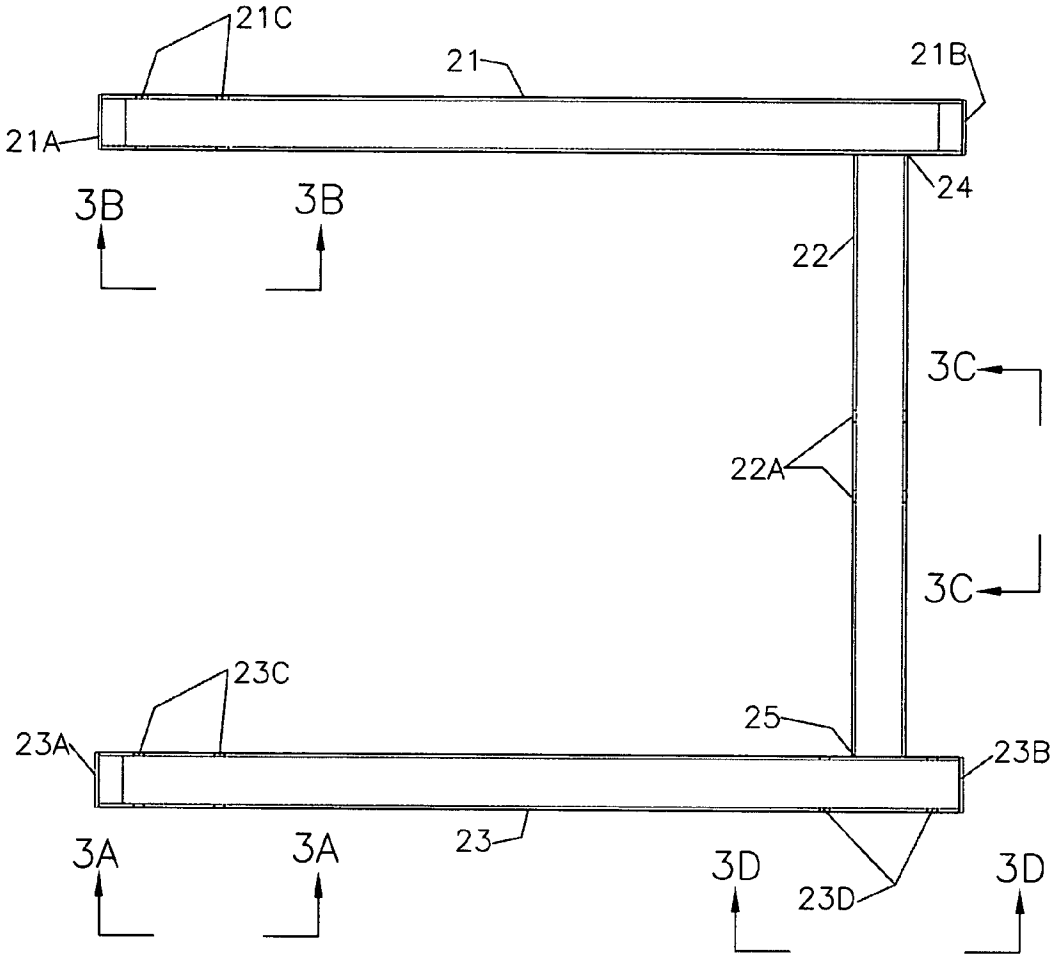
FIG. 3 shows a top view of the support base module for the upper body workout unit.
Figure 3C:
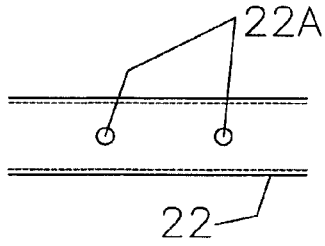
FIG. 3C shows a sectional view of a portion of the support base for the upper body workout unit.
Figure 3D:
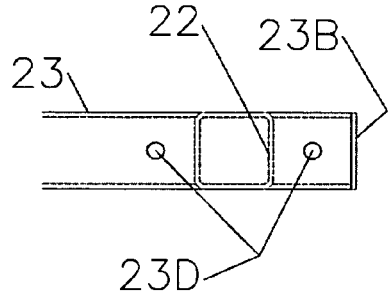
FIG. 3D shows a sectional view of a portion of the support base for the upper body workout unit.
Figure 3A:
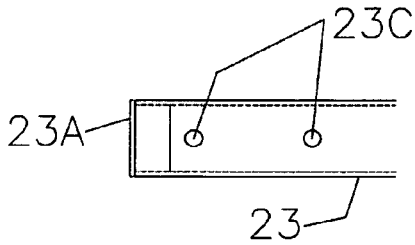
FIG. 3A shows a sectional view of a portion of the support base for the upper body workout unit.
Figure 3B:
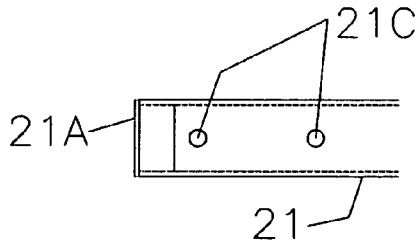
FIG. 3B shows a sectional view of a portion of the support base for the upper body workout unit.
Figure 7:
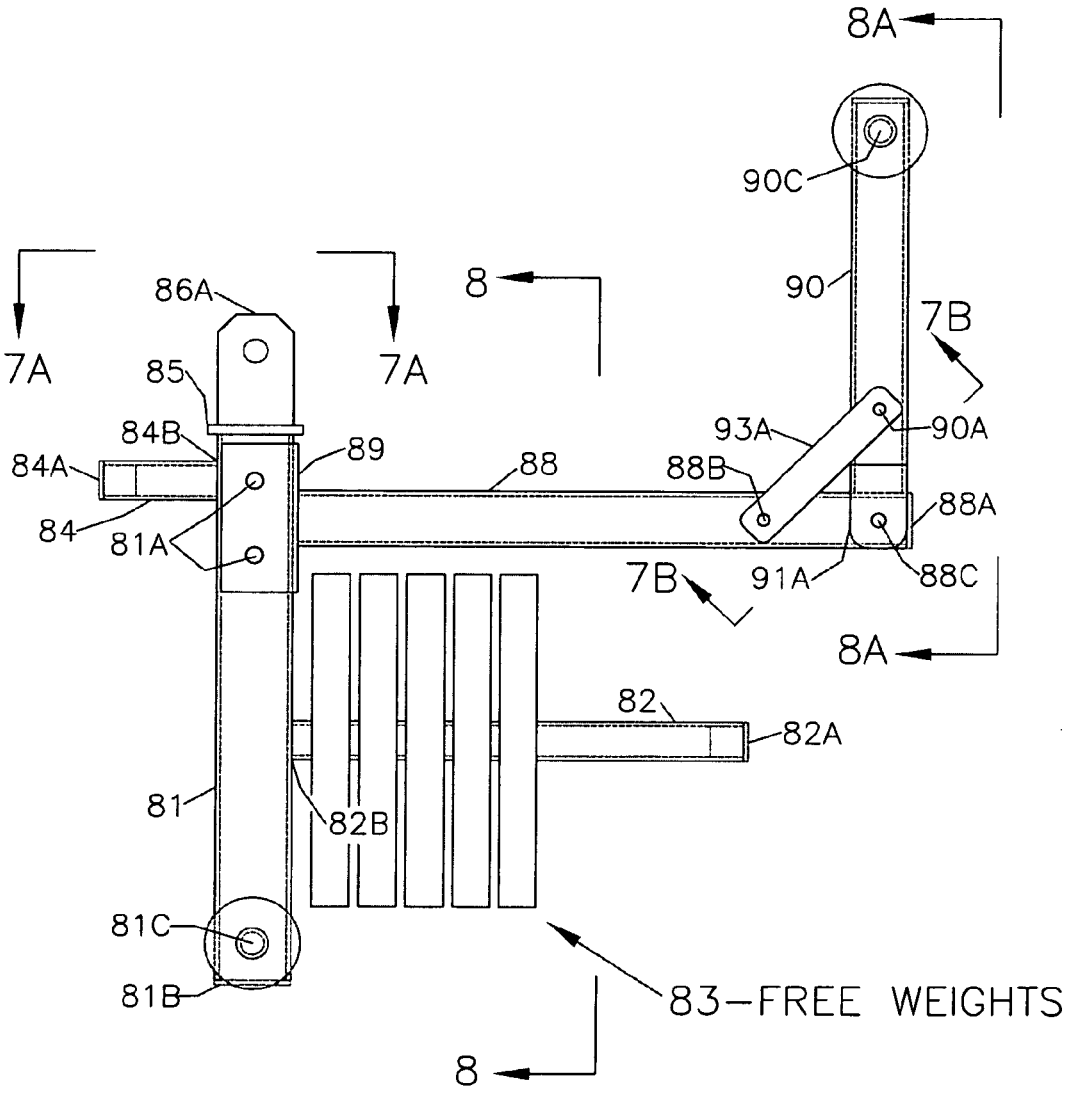
FIG. 7 shows right side elevation of the leg curl/extension workout unit.
Figure 7B:
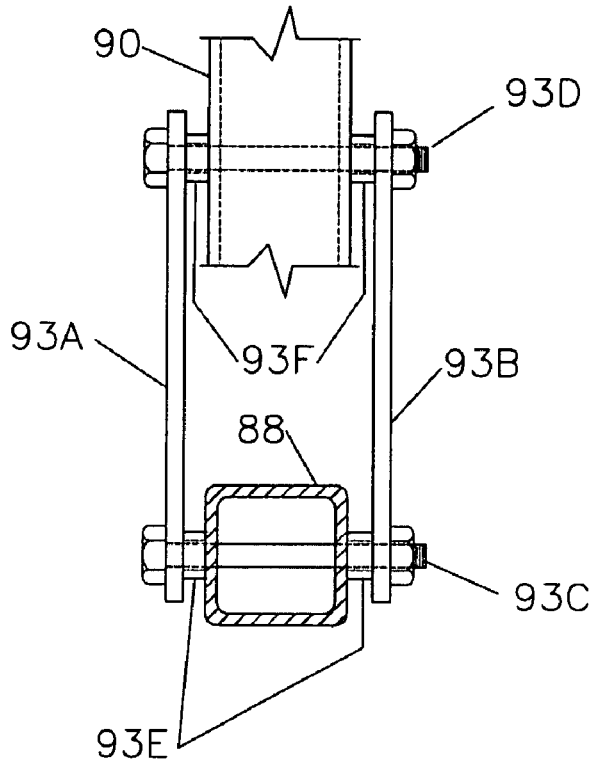
FIG. 7B shows a sectional detail of linkage bars for the leg curl/extension workout unit.
Figure 7A:
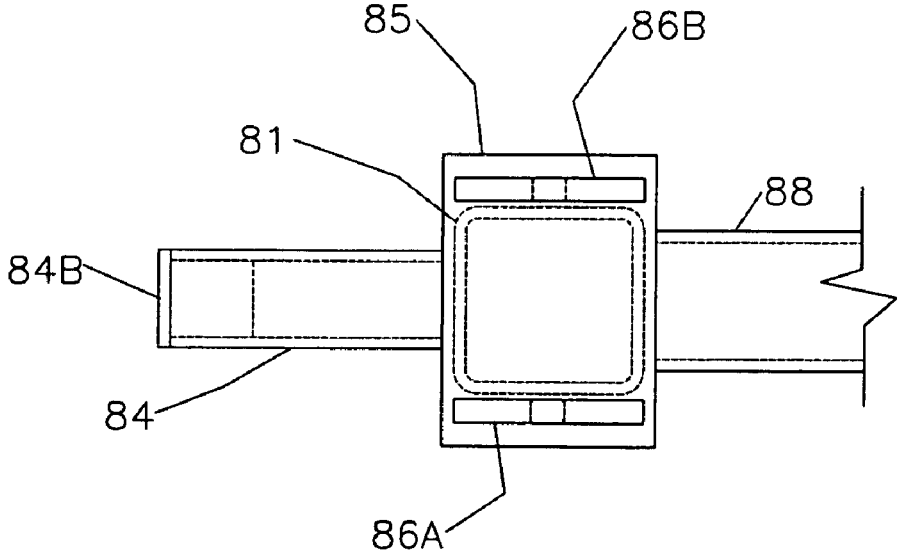
FIG. 7A shows a sectional detail of a cap plate for the leg curl/extension workout unit.
Figure 8:
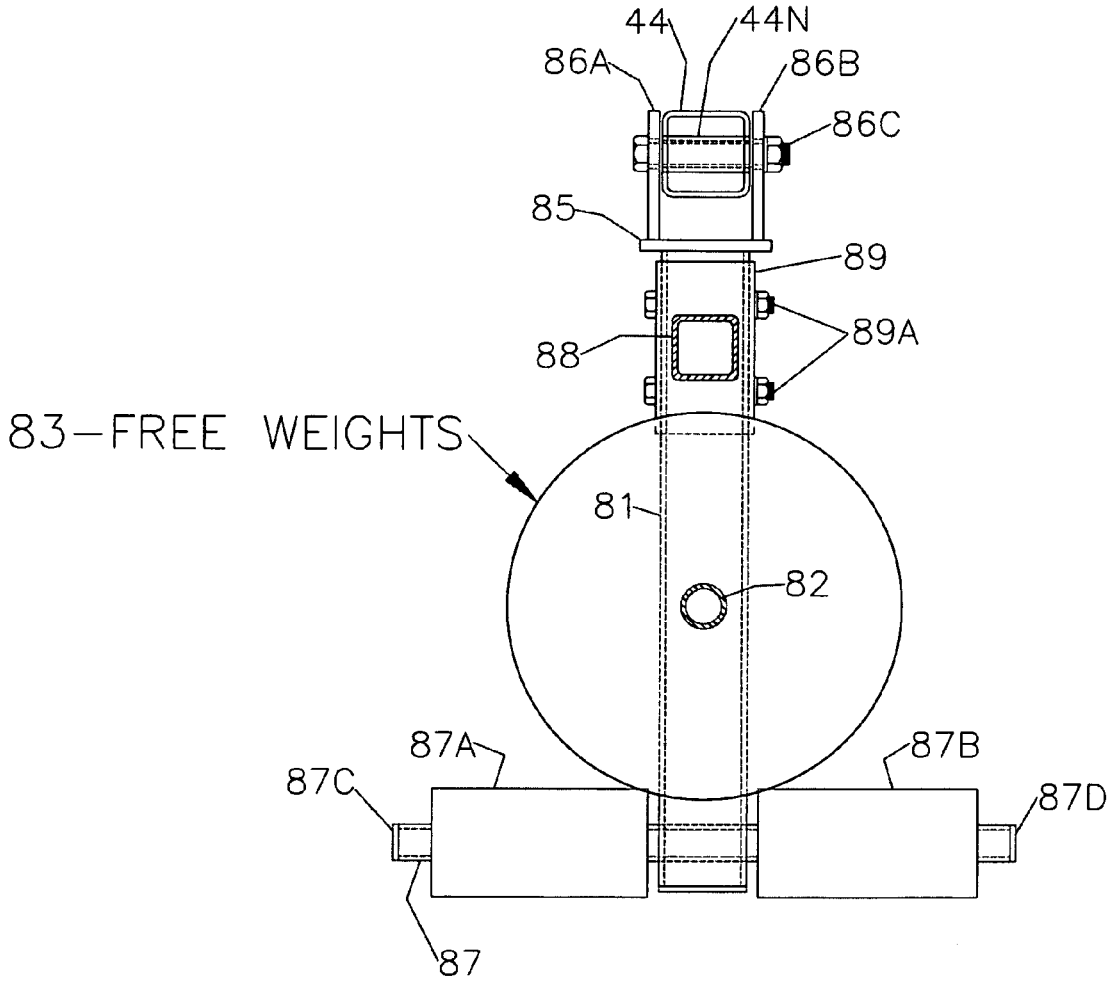
FIG. 8 shows a sectional front view of the leg curl/extension workout unit.
Figure 8A:
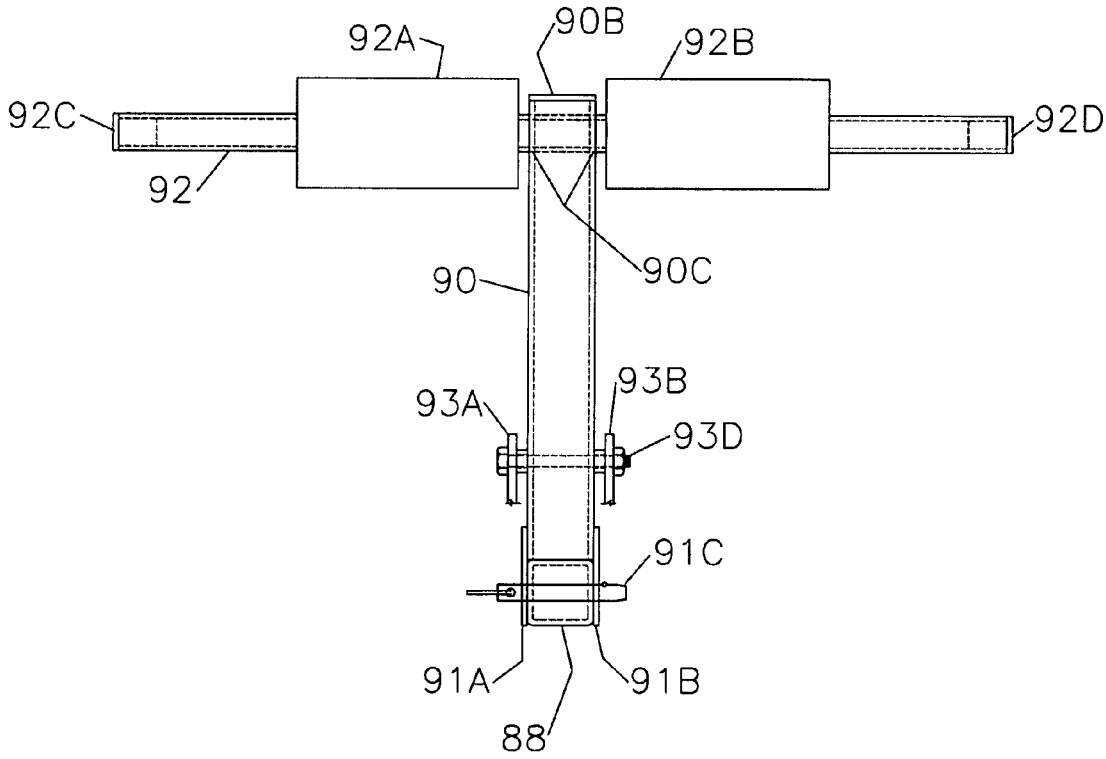
FIG. 8A shows a sectional view of a lever mechanism for the leg curl/extension workout unit.

FIG. 2A shows the right side elevation of the combined upper body workout unit 20 and leg curl/extension workout unit 80. FIG. 7 shows the right side elevation of unit 80 by itself and FIG. 8 shows a sectional front view of unit 80. With reference to FIGS. 7, 7A, 7B, 8, and 8A a resistance mechanism is comprised of upright tube 81 with bushing 81B at its bottom end. Hollow cylinder 82 is transversely affixed to tube 81 at location 82B extending outwards there from. Cylinder 82 has bushing 82A at its free end. Tube 81 has a pair of parallel transverse through holes 81A adjacent its top end, a single large transverse through hole 81C adjacent its bottom end and a flat cap plate 85 affixed to its top end. Two oppositely disposed parallel plates 86A and 86B are affixed perpendicular to the top surface of cap plate 85 extending upwards there from and having oppositely disposed parallel openings. A short hollow cylinder 84 having bushing 84A is transversely affixed to tube 81 at location 84B. Hollow cylinder 82 carries free weights 83. Lever for leg extension exercise is comprised of hollow cylinder 87 having bushings 87C and 87D at each end inserted in hole 81C of tube 81 and affixed in place extending outwards there from equally on both sides of tube 81. Cylindrical cushions 87A and 87B are fitted over cylinder 87 adjacent its either end. A collapsible lever mechanism for leg curl exercise is comprised of horizontal tube 88 having bushing 88A at its distal end and a bent plate 89 affixed to its proximal end extending outwards there from and having a pair of oppositely disposed parallel openings which match in size and location the pair of through holes 81A in upright tube 81. Tube 88 has a single transverse through hole 88C adjacent its distal end and a second transverse through hole 88B at a location a third of its lengthwise distance in from the distal end. Tube 88 is connected to tube 81 by installing a pair of fasteners 89A in through holes 81A. Upright tube 90 having end plug 90B at its top end, a large transverse through hole 90C adjacent its top end and a single transverse through hole 90A adjacent its bottom end makes up the second major component of the leg curl lever mechanism. Hollow cylinder 92 having bushings 92C and 92D at its either end is inserted in the large transverse through hole 90C and affixed in place extending outwards there from equally on either side of tube 90. Cylindrical cushions 92A and 92B are fitted over cylinder 92 on either side of tube 90. Two oppositely disposed parallel plates 91A and 91B are affixed to tube 90 adjacent its bottom end on either side of it extending downwards there from and having oppositely disposed parallel openings. Two oppositely disposed parallel linkage bars 93A and 93B are provided to link horizontal tube 88 to upright tube 90. Each of the linkage bars 93A and 93B has an opening adjacent its proximal and distal ends and which openings match in size and location through hole 88B of horizontal tube 88 and through hole 90A of upright tube 90 respectively. A pair of spacers 93E is installed on either side of tube 88 aligned with through hole 88B separating tube 88 and the linkage bars. In a similar manner, a pair of spacers 93F is installed on either side of tube 90 aligned with through hole 90A separating tube 90 and the linkage bars. Fastener 93C is installed to affix the linkage bars 93A and 93B to tube 88 at their proximal ends. Fastener 93D is installed to affix the distal ends of the linkage bars to tube 90. Fasteners 93C and 93D are tightened loosely to allow rotational movement of bars 93A and 93B and tube 90 at holes 88B and 90A. Lock pin 91C is installed after positioning bottom end of upright tube 90 on top of the distal end of horizontal tube 88 such that the openings in plates 91A and 91B are aligned with the through hole 88C adjacent the distal end of tube 88.

To attach unit 80 to unit 20, plates 86A and 86B atop cap plate 85 are positioned astride each side of longitudinal tube 44 of unit 20 so that the openings in plates 86A and 86B are aligned with pipe sleeve 44N installed in hole 44D adjacent the distal end of tube 44. Fastener 86C is then installed in sleeve 44N to complete the connection (FIG. 8).

Leg extension exercise is performed by positioning the user's feet astride the cylindrical cushions 87A and 87B and pushing on the cushions with the front of the feet to extend the legs forward. To accomplish this, the user sits upright on seat 49 facing unit 80, inserts the removable hollow cylinder handle 44E in hole 44B so that it extends outwards equally on both sides of longitudinal tube 44 (FIGS. 5 & 5D), holds firmly the handle 44E with both hands while at the same time pushing cushions 87A and 87B forward to extend the legs. Leg curl exercise is performed by positioning the back of the user's lower legs against cushions 92A and 92B with the legs being bent at the knee and pressing inwards on the cushions to curl the lower legs. To accomplish this, the user lies on his/her tummy on seats 49 and 117 facing unit 100 wrapping the arms around seat 117, bends the knee just beyond cylindrical cushions 44L and 44M and adjusts his/her position so that the back of the lower legs are comfortably positioned astride cushions 92A and 92B and presses in towards the buttock with the back of the lower legs to perform the leg curl exercise. In addition to leg curl/extension workouts, unit 80 can be used to perform arm curl exercises. To accomplish this, the user sits on seat 49 facing unit 80, holds the ends of hollow cylinder handle 92 with both hands and pulls in handle 92 towards herself/himself to perform the arm curl exercises.

Figure 1B:
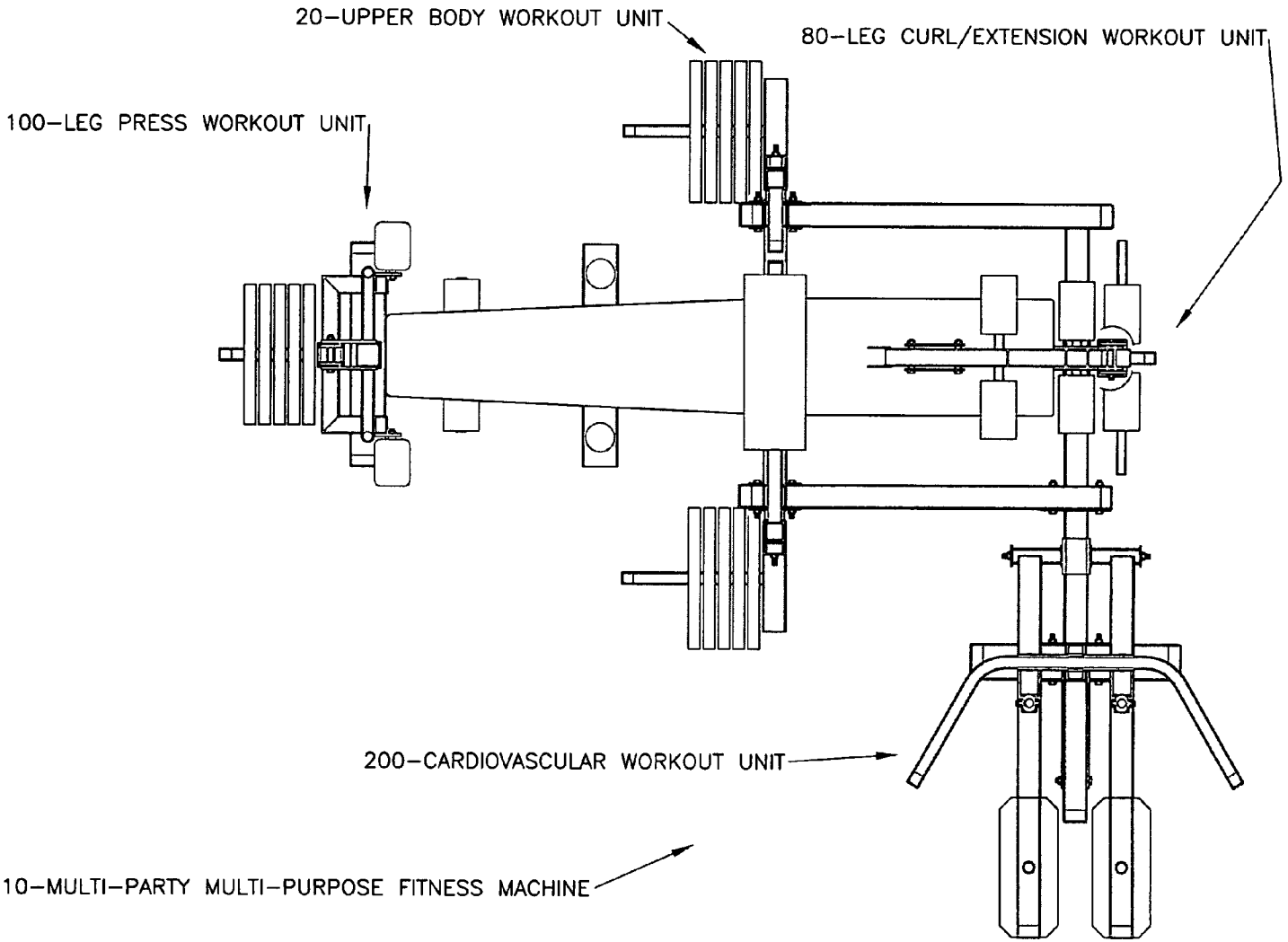
FIG. 1B shows top view of the multi-party multi-purpose fitness machine in storage mode.
Figure 1C:
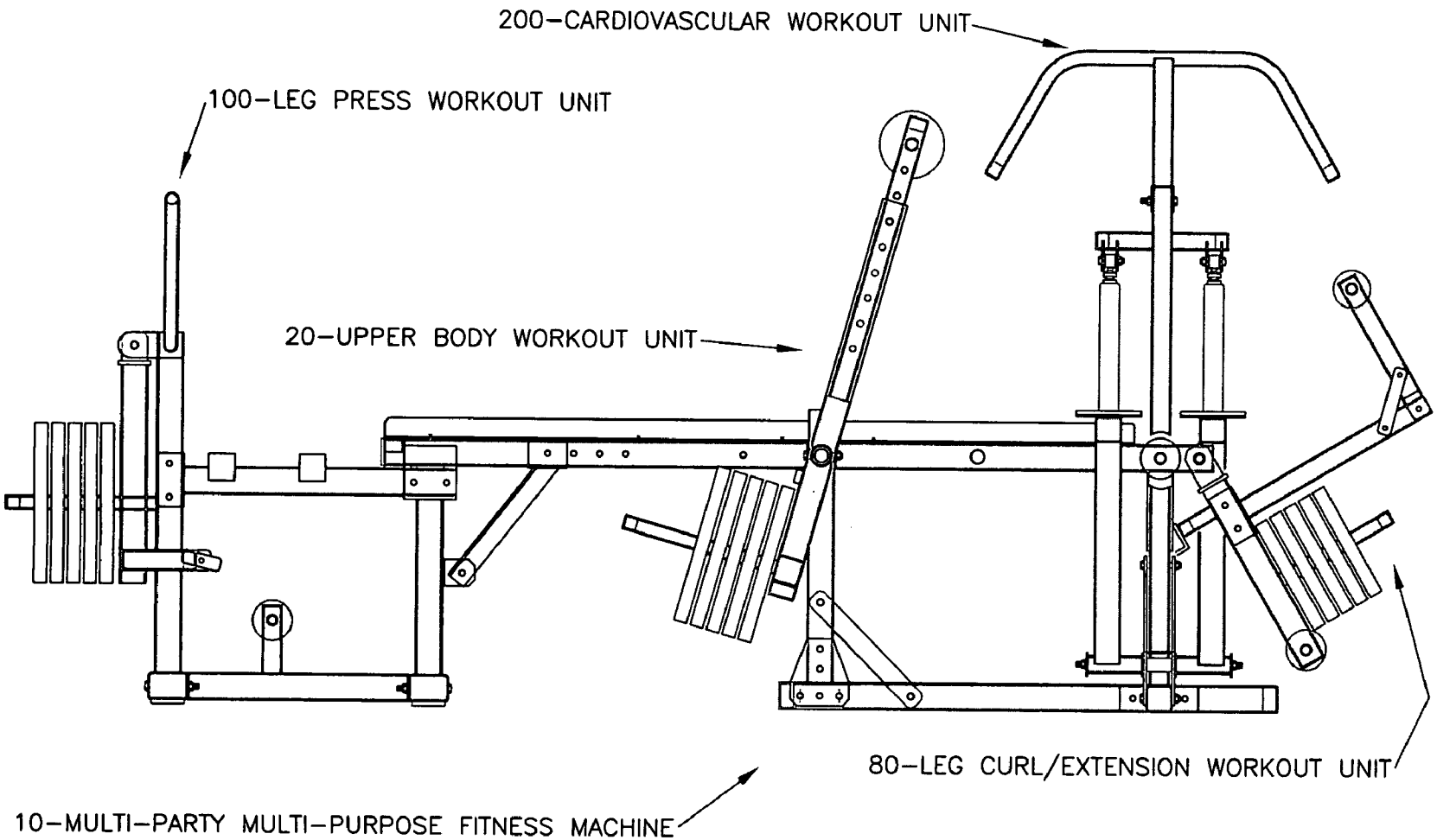
FIG. 1C shows right side elevation of the multi-party multi-purpose fitness machine in fully extended operational mode.
Figure 1D:
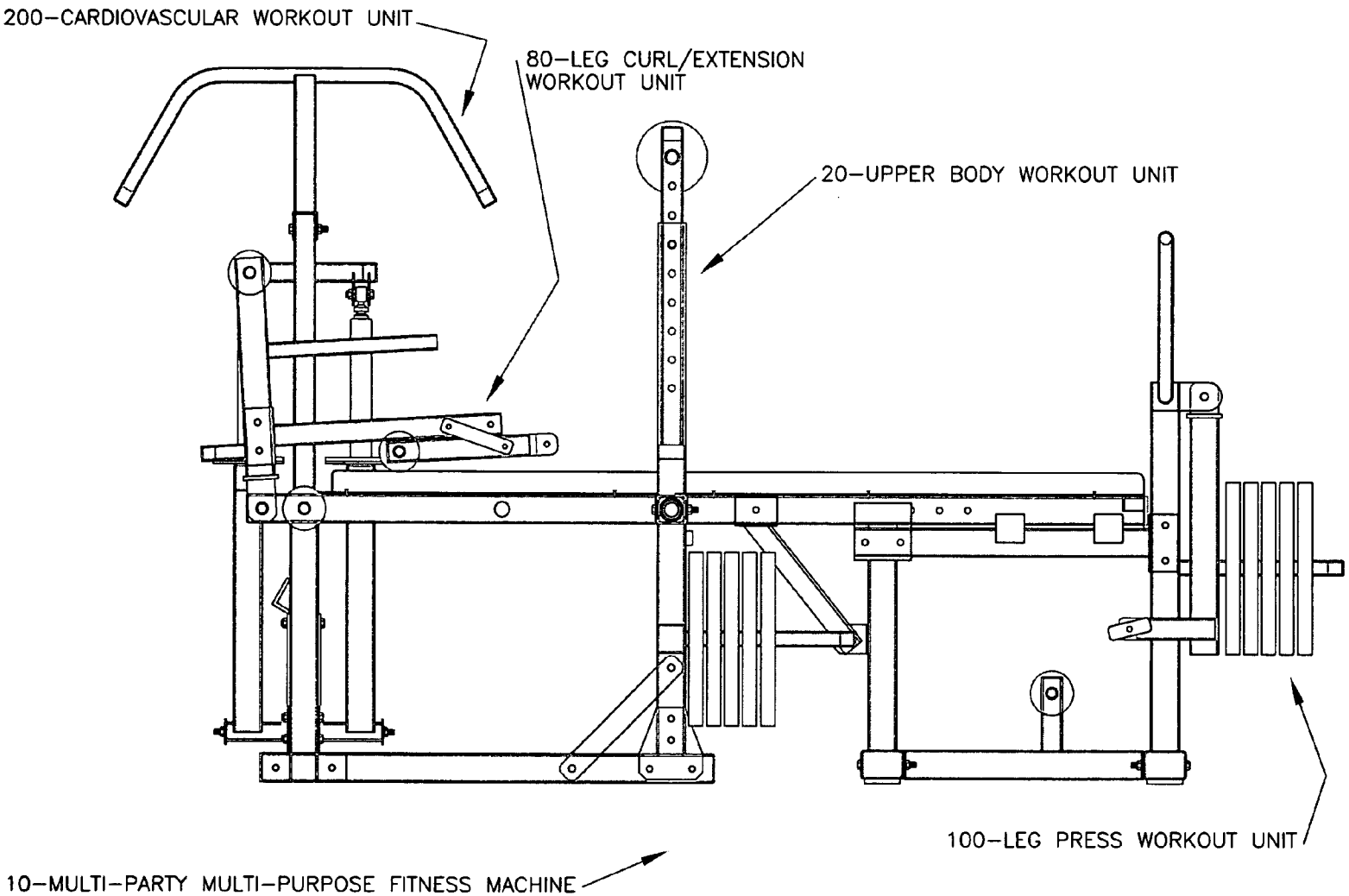
FIG. 1D shows left side elevation of the multi-party multi-purpose fitness machine in a storage mode.
Figure 1E:
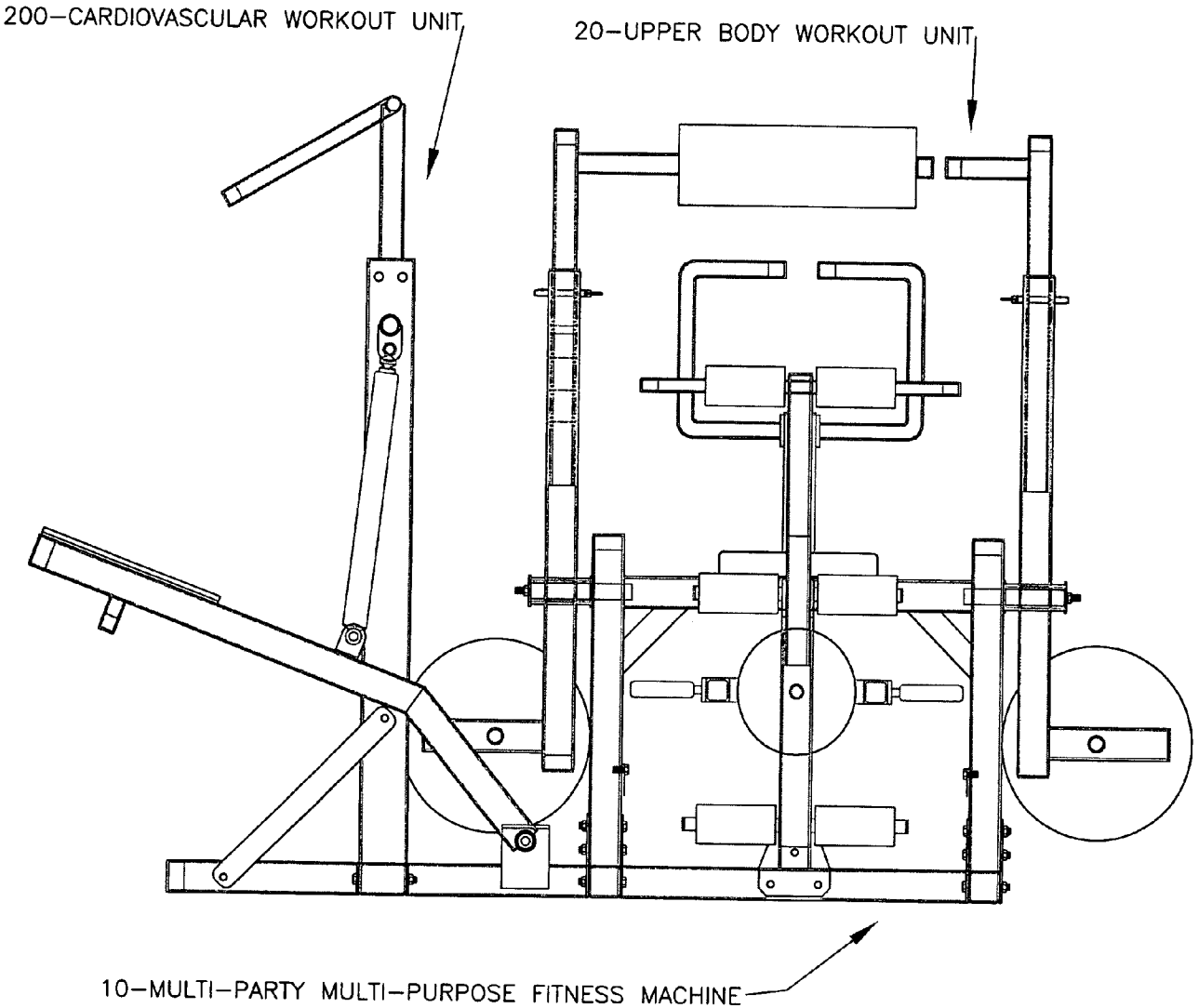
FIG. 1E shows front view of the multi-party multi-purpose fitness machine in operational mode.

When fitness machine 10 is not in use, lock pin 91C can be removed to collapse the leg curl lever by rotating tube 90 and linkage bars 93A and 93B about holes 88B and 90A. Once tube 90 is collapsed on top of tube 88, free weights 83 are removed temporarily to allow the rotation of the entire unit 80 about pipe sleeve 44N of unit 20 so that unit 80 can rest on top of seat 49 of unit 20 as shown in FIGS. 1B and 1D.

3. Description of the Leg Press Workout Unit 100

Figure 9:
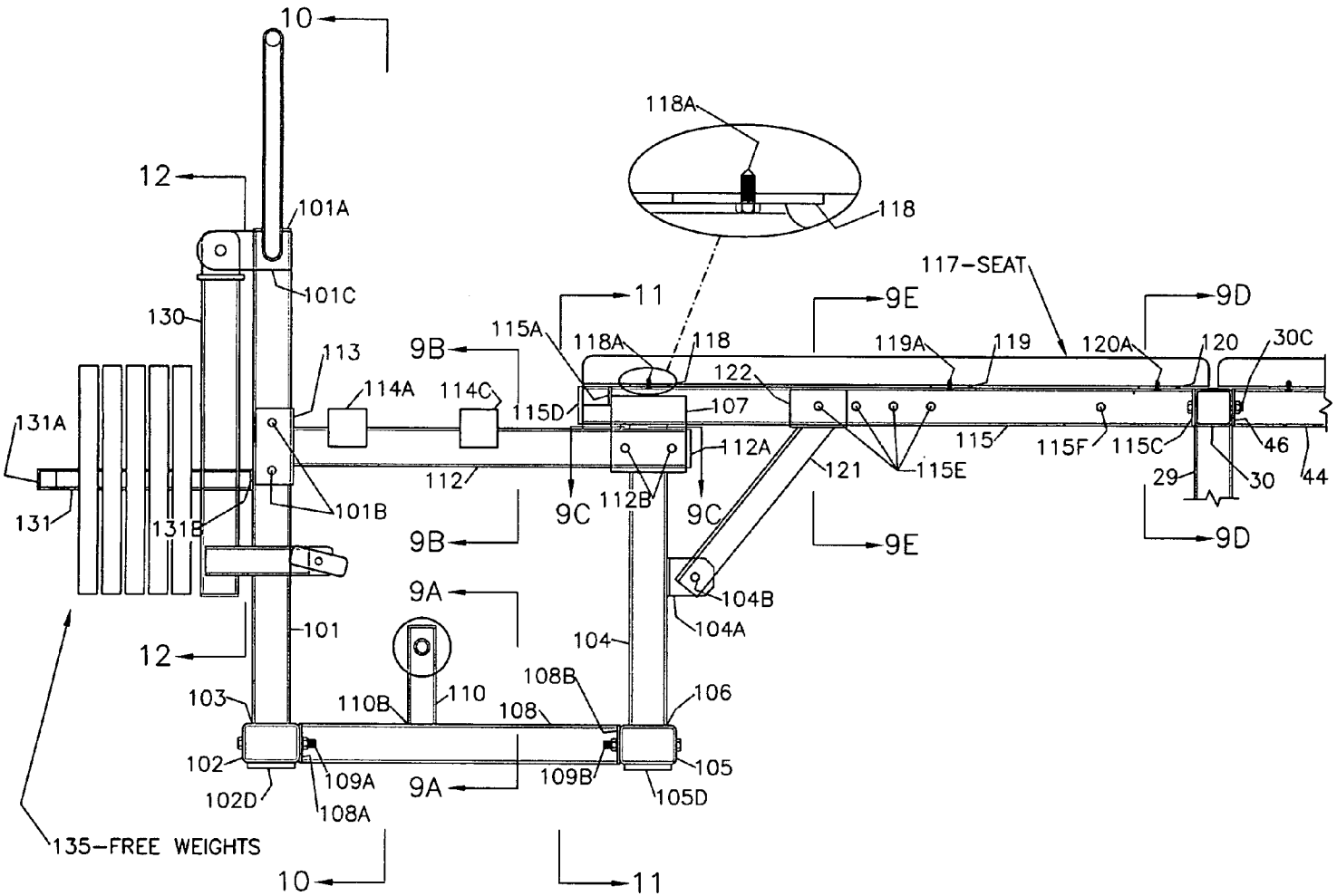
FIG. 9 shows right side elevation of the leg press workout unit.
Figure 10:
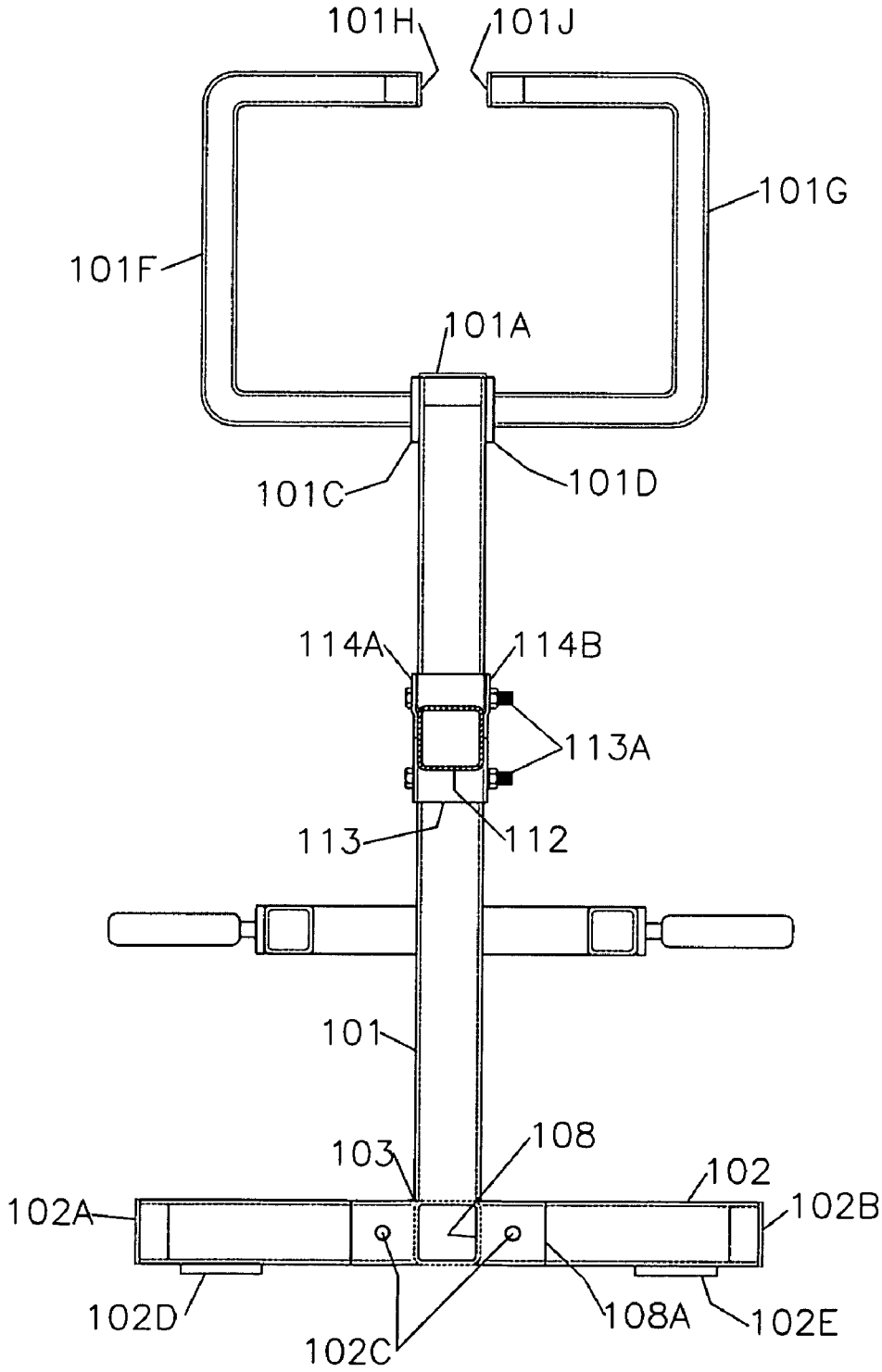
FIG. 10 shows sectional elevation of exterior support frame for the leg press workout unit.

FIG. 9 shows right side elevation of leg press workout unit 100 attached to rear support frame of unit 20. With reference to FIGS. 9 and 10, an exterior support frame is comprised of an upright tube 101 having bushing 101A at its top end affixed perpendicularly at its bottom end to top of horizontal tube 102 at location 103. Tube 101 has a pair of parallel transverse through holes 101B centered on its lengthwise center location and a pair of oppositely disposed parallel plates 101C and 101D affixed to its sides adjacent its top end extending outwards there from and having a pair of oppositely disposed openings. Two oppositely disposed U-shaped hollow cylinder handles 101F and 101G each having bushings 101H and 101J at their respective distal ends are affixed at their proximal ends to the sides of plates 101C and 101D respectively adjacent the top end of tube 101. Horizontal tube 102 has bushings 102A and 102B at its either end, a pair of parallel transverse through holes 102C centered on its lengthwise center location and a pair of oppositely disposed roller/gliders 102D and 102E affixed to its underside adjacent its either end.

Figure 11:
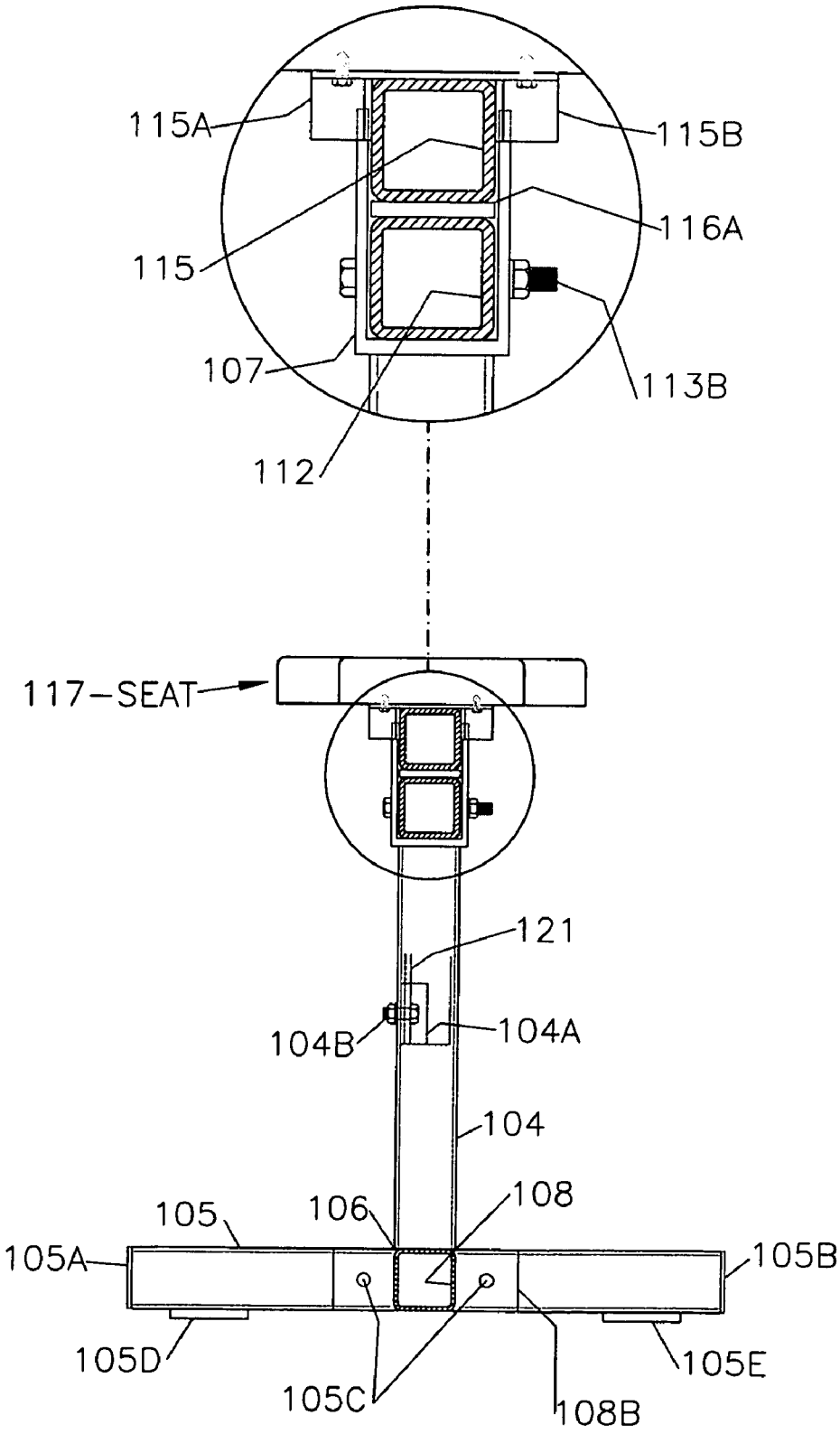
FIG. 11 shows sectional elevation of interior support frame for the leg press workout unit.
Figure 12:
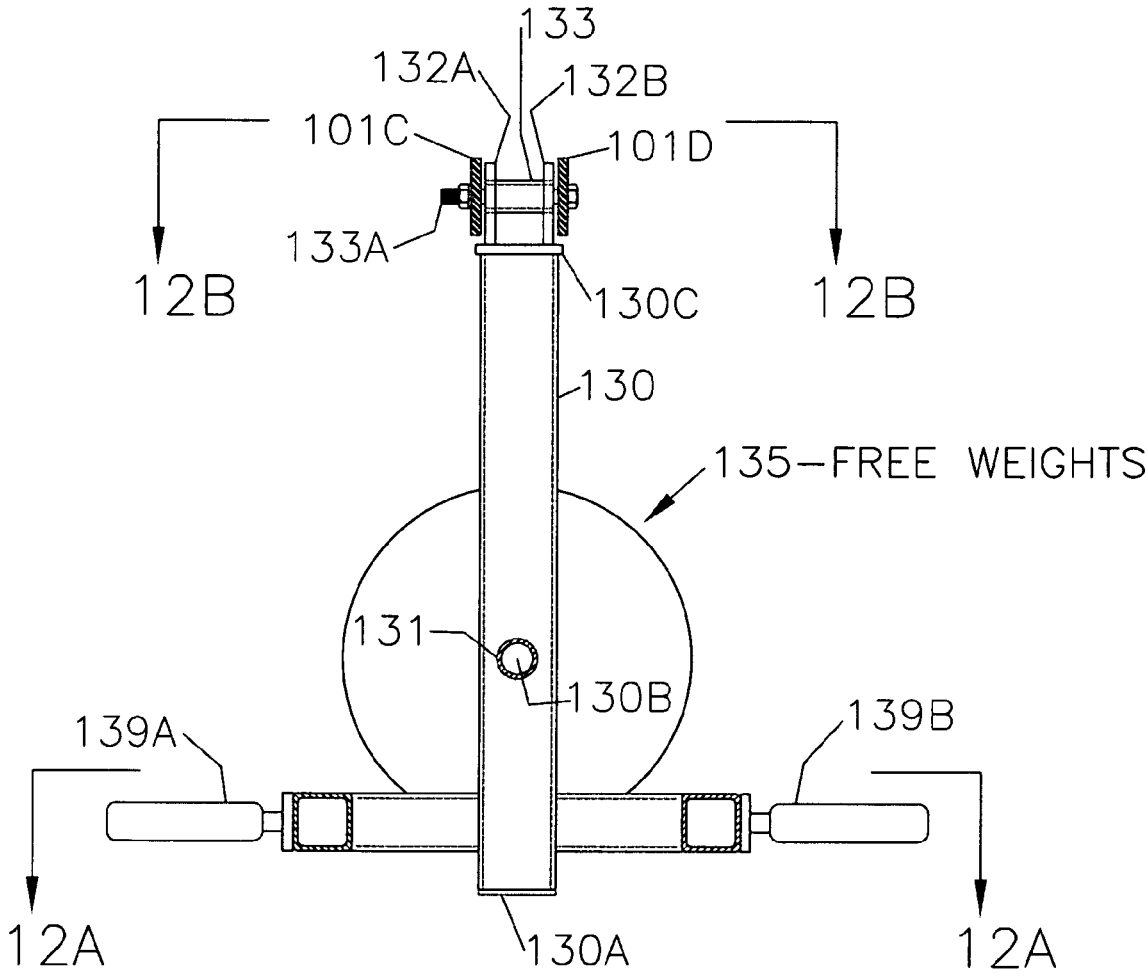
FIG. 12 shows sectional elevation of resistance mechanism for the leg press workout unit.
Figure 12B:
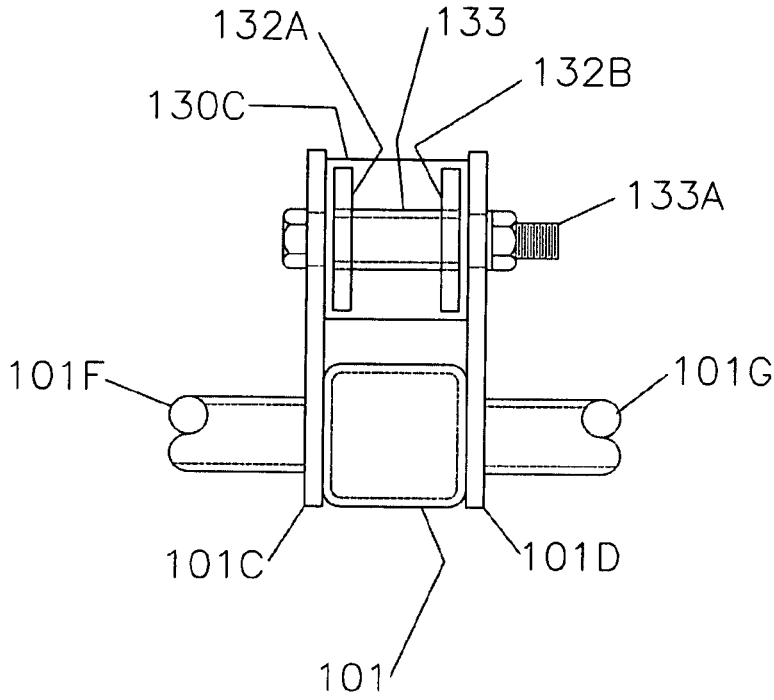
FIG. 12B shows connection detail for the leg press workout unit.
Figure 12A:
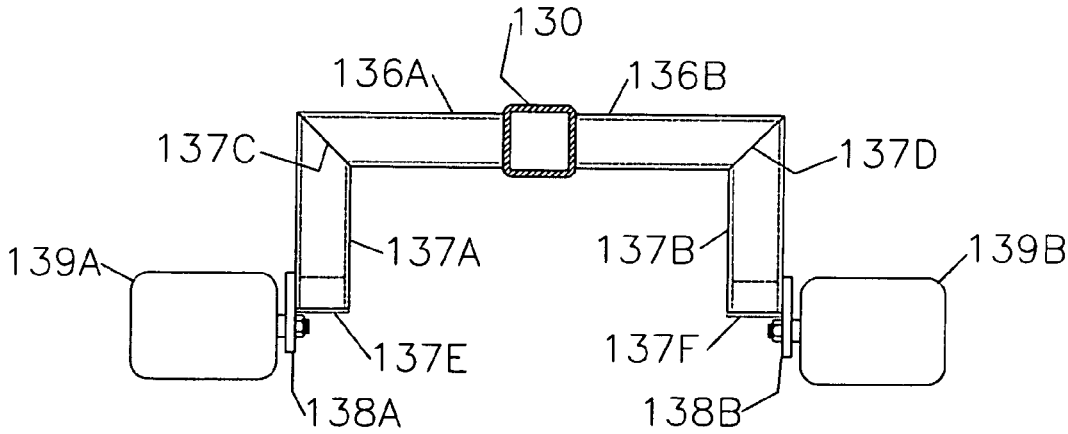
FIG. 12A shows sectional top view of lever mechanism for the leg press workout unit.

With reference to FIGS. 9 and 11, an interior support frame is comprised of upright tube 104 affixed perpendicularly to top of horizontal tube 105 at location 106. Upright tube 104 has L-shaped bent plate 104A affixed to it adjacent its lengthwise center location extending outwards there from. Bent plate 104A has an opening adjacent its free end. U-shaped bent plate 107 having a pair of oppositely disposed parallel openings is affixed to top of tube 104 extending upwards there from. Horizontal tube 105 has a pair of parallel transverse through holes 105C centered on its lengthwise center location, bushings 105A and 105B at its either end and a pair of oppositely disposed roller/gliders 105D and 105E affixed to its underside adjacent its either end.

Figure 9A:
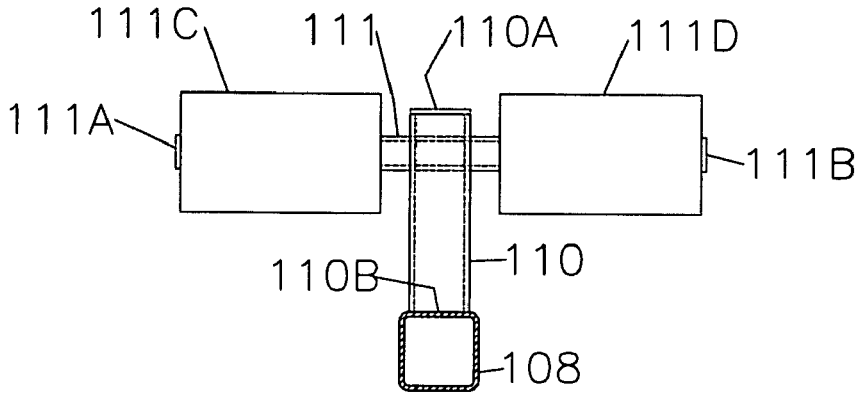
FIG. 9A shows a sectional view of feet restraint mechanism.
Figure 9B:
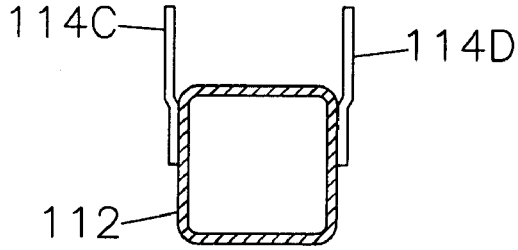
FIG. 9B shows a sectional view of guide plates for the leg press workout unit.

With reference to FIGS. 9, 10 and 11, a bottom strut is comprised of horizontal tube 108 having a pair of oppositely disposed rectangular connector plates 108A and 108B affixed to its proximal and distal ends respectively. Connector plate 108A has a pair of oppositely disposed openings which match in size and location holes 102C in tube 102 and plate 108B has a pair of oppositely disposed openings which match in size and location holes 105C in tube 105. A set of two fasteners 109A is installed in holes 102C to affix proximal end of tube 108 by way of plate 108A to tube 102. A second set of identical fasteners 109B is installed in holes 105C to affix distal end of tube 88 by way of plate 108B to tube 105. A short upright tube 110 having bushing 110A at its top end and a large transverse through hole adjacent its top end is affixed to top of strut tube 108 at its bottom end at location 110B extending upwards there from. A hollow cylinder 111 with oppositely disposed bushings 111A and 111B at its either end is inserted in the hole adjacent the top end of tube 110 and affixed in place extending outwards there from equally on either side of tube 110 (FIG. 9A). Cylindrical cushions 111C and 111D are fitted over cylinder 111 adjacent its either end. A top strut is comprised of horizontal tube 112 having a bushing 112A at its distal end, a pair of parallel transverse though holes 112B adjacent its distal end and U-shaped bent plate 113 affixed to its proximal end extending outwards there from and having a pair of oppositely disposed parallel openings. Through holes 112B match in size and location the pair of oppositely disposed parallel openings in bent plate 107. A pair of fasteners 113A is installed to affix the bent plate 113 at the proximal end of strut tube 112 to upright tube 101. Another pair of fasteners 113B is installed to affix the distal end of strut tube 112 to bent plate 107 at the top end of upright tube 105. Two oppositely disposed parallel guide plates 114A and 114B are affixed to either side of strut tube 112 adjacent its proximal end while two other identical guide plates 114C and 114D are affixed in same manner adjacent the lengthwise center location of tube 112 (FIG. 9B).

Figure 9C:
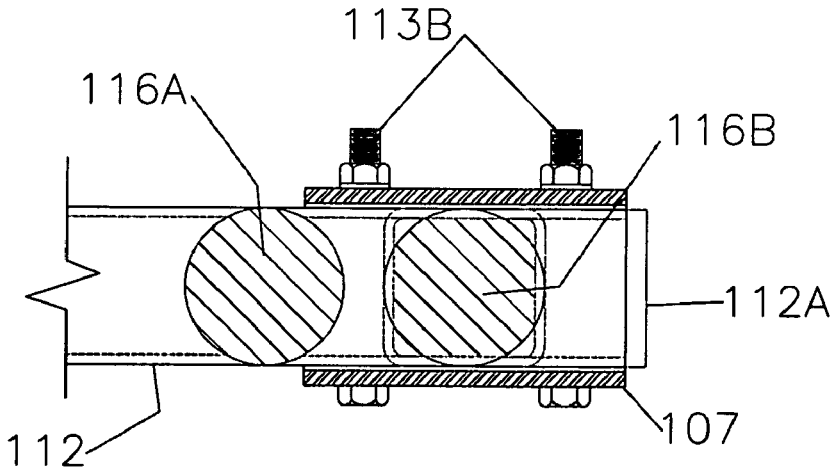
FIG. 9C shows sectional view of glider discs for the leg press workout unit.
Figure 9D:
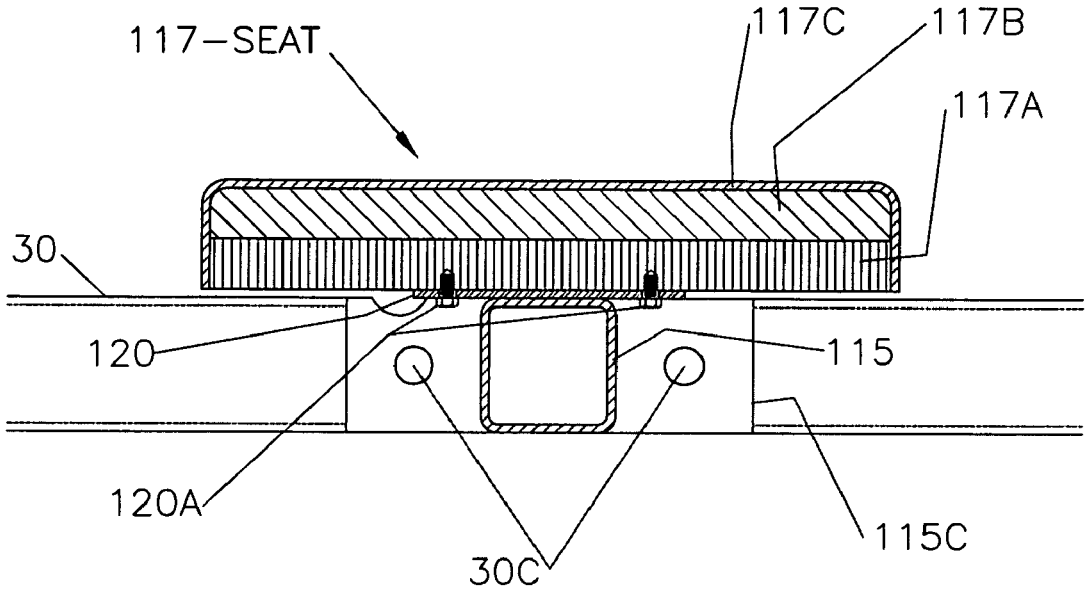
FIG. 9D shows sectional view of seat for the leg press workout unit.

With reference to FIGS. 9, 9D and 11, a seat frame is comprised of longitudinal tube 115 having a pair of oppositely disposed stop angles 115A and 115B affixed to its either side adjacent its proximal end, a bushing 115D at its proximal end and a rectangular connector plate 115C affixed to it distal end and which plate has a pair of oppositely disposed openings which match in size and location holes 30A in tube 30 of the upper body workout unit 20 (FIGS. 4A & 5C). Tube 115 is connected to tube 30 by way of plate 115C using fasteners 30B installed in holes 30A. Tube 115 in essence connects leg press workout unit 100 to upper body workout unit 20. Tube 115 has a set of four equally spaced transverse parallel through holes 115E adjacent its lengthwise center location and another hole 115F close to its distal end. Glider disc 116A is attached to the underside of tube 115 adjacent its proximal end while an identical glider disc 116B is attached to top surface of tube 112 adjacent its distal end (FIG. 9C). Glider discs 116A and 116B assist tube 115 to easily glide over top strut tube 112 during retraction and/or extension of unit 100. During full extension of unit 100, stop angles 115A and 115B engage bent plate 107 thereby eliminating contact between glider discs 116A and 116B in addition to eliminating separation of units 20 and 100.

Figure 9E:
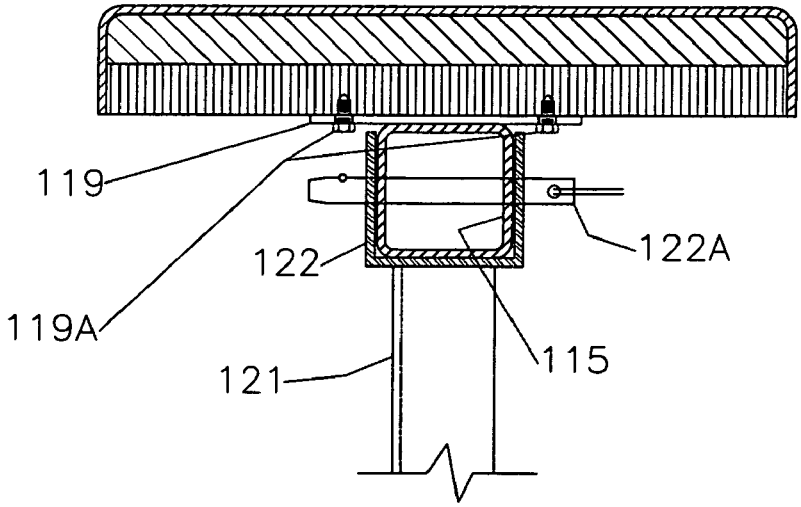
FIG. 9E shows sectional view of a lock brace component for the leg press workout unit.

With reference to FIGS. 9 and 9D and 9E, a seat 117 is comprised of a seat base 117A having variable width, a seat cushion 117B and a seat cover 117C affixed to the seat base 117A. Seat 117 is supported on three rectangular plates 118, 119, and 120 with each plate having a pair of oppositely disposed openings and with plate 118 being affixed to top of tube 115 adjacent the proximal end of tube 115. Plates 119 and 120 are affixed in like manner adjacent the lengthwise center location and the distal end of tube 115 respectively. Seat 117 is affixed to plates 118, 119 and 120 using self-tapping fasteners 118A, 119A and 120A respectively.

With reference to FIGS. 9 and 9E, a lock brace mechanism is comprised of an angle member 121 with an opening adjacent its bottom end and a U-shaped bent plate 122 affixed to its top end and. Bent plate 122 has a pair of oppositely disposed parallel openings which match in size holes 115E and 115F of tube 115. Angle 121 is affixed to bent plate 104A at its bottom end using fastener 104B. Fastener 104B is tightened just enough to allow free rotational movement of angle 121. After adjusting the position of unit 100 by aligning any of the holes 115E and 115F with the one hole in bent plate 122, lock pin 122A is inserted to interlock tube 115 with member 121 thus locking up unit 100 in place. Any time a user wants to adjust the position of unit 100, one has to remove the free weights 135 first, then remove the lock pin 122A, rotate away member 121 and push in or pull out the front end of unit 100 as desired for retraction or extension respectively. The roller gliders 102D, 102E, 105D and 105E along with glider discs 116A and 116B come into play to facilitate the retraction and/or extension process. Once the desired position of unit 100 is attained, member 121 is rotated back so that the openings in bent plate 122 are aligned with any of the through holes 115E or 115F and lock pin 122A is installed to lock up unit 100 in place.

With reference to FIGS. 9, 12, 12A and 12B, a resistance mechanism is comprised of upright tube 130 with bushing 130A at its bottom end, a perpendicular through hole 130B adjacent a location a third of its lengthwise distance up from the bottom end and a cap plate 130C affixed to its top end. Two oppositely disposed parallel plates 132A and 132B are affixed perpendicular to top surface of cap plate 130C extending upwards there from and having oppositely disposed parallel openings. Pipe sleeve 133 is affixed between plates 132A and 132B with the openings in the plates being aligned with sleeve 133. A hollow cylinder 131 having a pair of oppositely disposed bushings 131A and 131B at its either end in inserted into hole 130B and affixed in place in such a manner that a small length of cylinder 131 protrudes on the back side to act as stop mechanism against the side of upright tube 101. Cylinder 131 provides support for free weights 135. A lever mechanism is comprised of two oppositely disposed horizontal tubes 136A and 136B affixed to either side of tube 130 adjacent its bottom end. Two oppositely disposed parallel tubes 137A and 137B are affixed to tubes 136A and 136B at locations 137C and 137D respectively. Tube 137A has bushing 137E at its free end and a plate 138A affixed adjacent its free end extending outwards there from and having an opening near its end. Tube 138A has bushing 137F at its free end and a plate 138B affixed adjacent its free end extending outwards there from and having an opening near the end. Foot rest pedal 139A is affixed to plate 138A by inserting the threaded connection end of the pedal 139A into the opening of plate 138A and installing a fastener to connect the pedal 139A to the plate 138A. In a similar manner, foot rest pedal 139B is affixed to plate 138B by inserting the threaded connection end of the pedal 139B into the opening of plate 138B and installing a fastener to connect the pedal 139B to the plate 138B. To mount upright tube 130 to top of upright tube 101, plates 132A and 132B are positioned such that pipe sleeve 133 is aligned with the oppositely disposed parallel openings in plates 101C and 101D and fastener 133A is installed to complete the connection.

Leg press exercise is performed by applying forces at the pedals 139A and 139B. To accomplish this, the user sits upright on seat 117, rests his/her feet on the pedals 139A and 139B, holds firmly the U-shaped hollow cylinder handles 101F and 101G with his/her hands while pushing away the pedals 139A and 139B with both feet to perform the leg press exercise.

4. Description of the Cardiovascular Workout Unit 200

Figure 13:
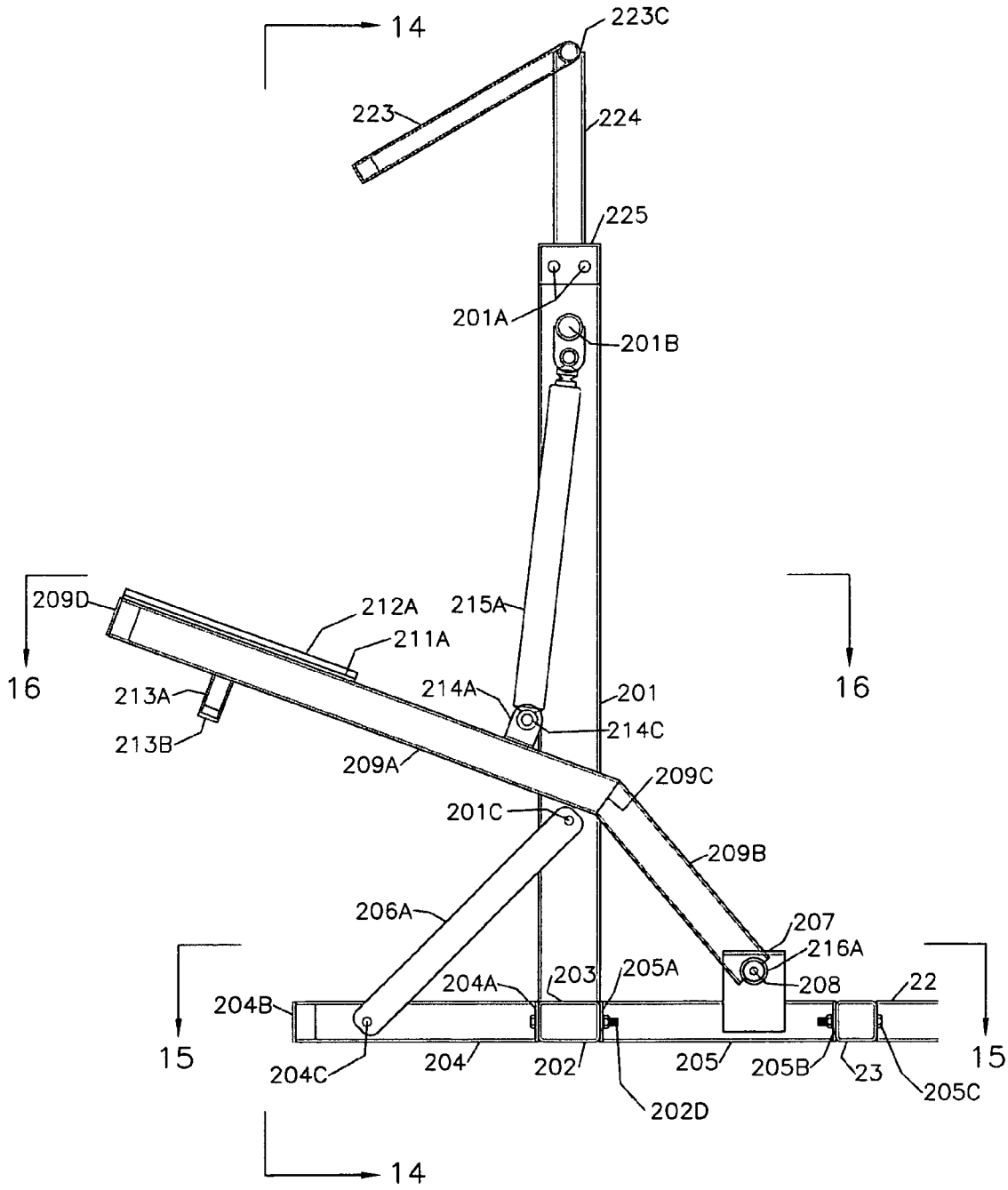
FIG. 13 shows right side elevation of the cardiovascular workout unit.
Figure 14:
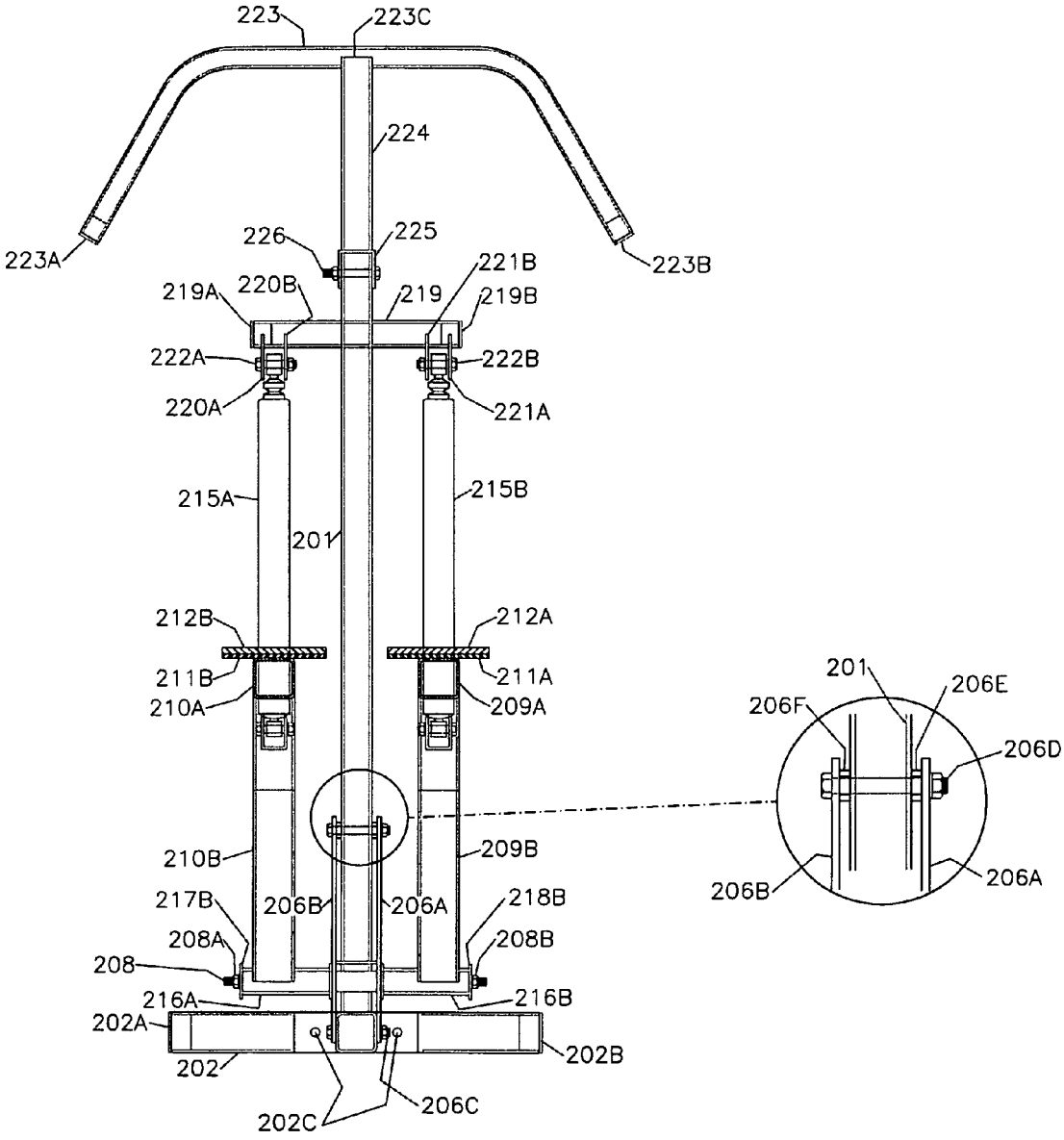
FIG. 14 shows sectional front elevation of the cardiovascular workout unit.

Side elevation of cardiovascular workout unit 200 is shown in FIG. 13. Front sectional elevation is shown in FIG. 14. A vertical support frame is comprised of upright tube 201 having a pair of oppositely disposed parallel transverse through holes 201A adjacent its top end, a single large transverse through hole 201B adjacent and centered on holes 201A and a third transverse through hole 201C adjacent a location a third of its lengthwise distance up from the bottom end. Tube 201 is affixed to top of horizontal tube 202 at location 203.

Tube 202 has bushings 202A and 202B at its either end and a pair of parallel transverse through holes 202C centered on its lengthwise center location.

Figure 15:
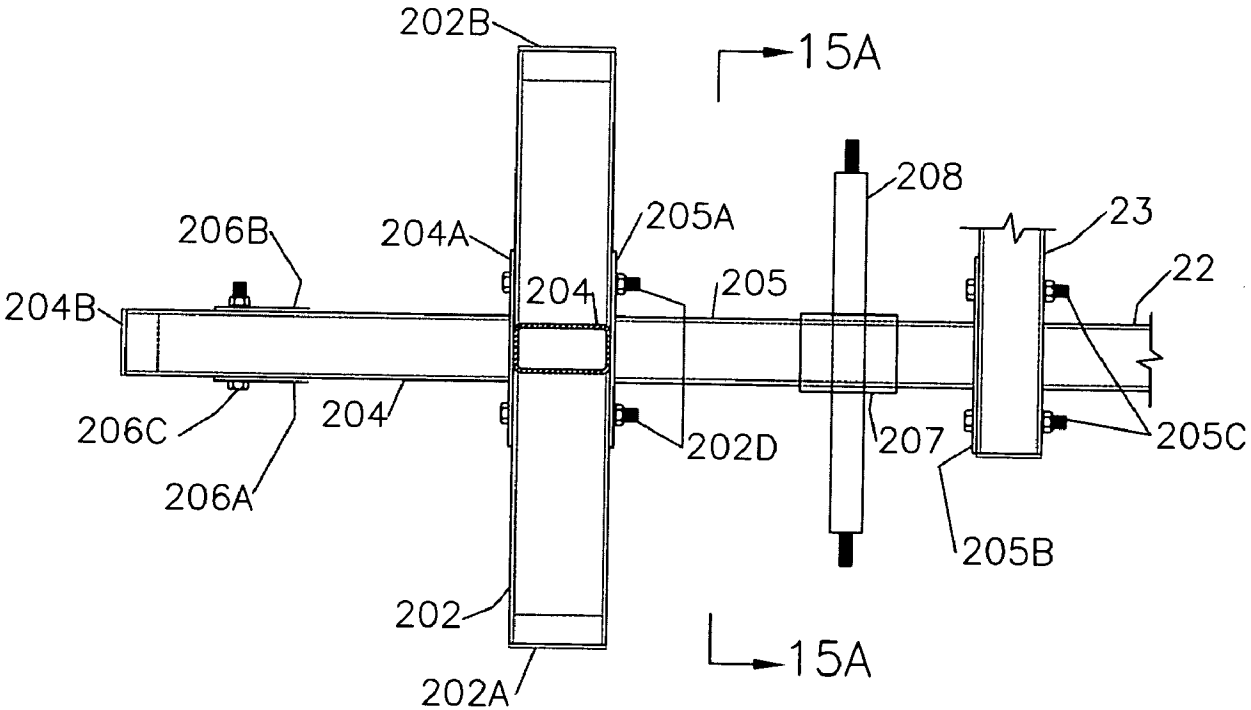
FIG. 15 shows sectional top view of base of the cardiovascular workout unit.
Figure 15A:
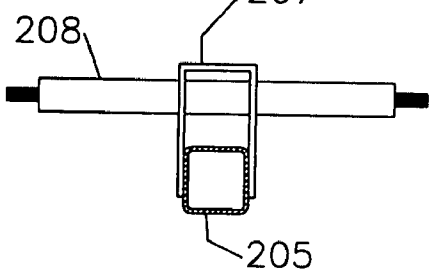
FIG. 15A shows detail of pivot joint for the cardiovascular workout unit.
Figure 16:
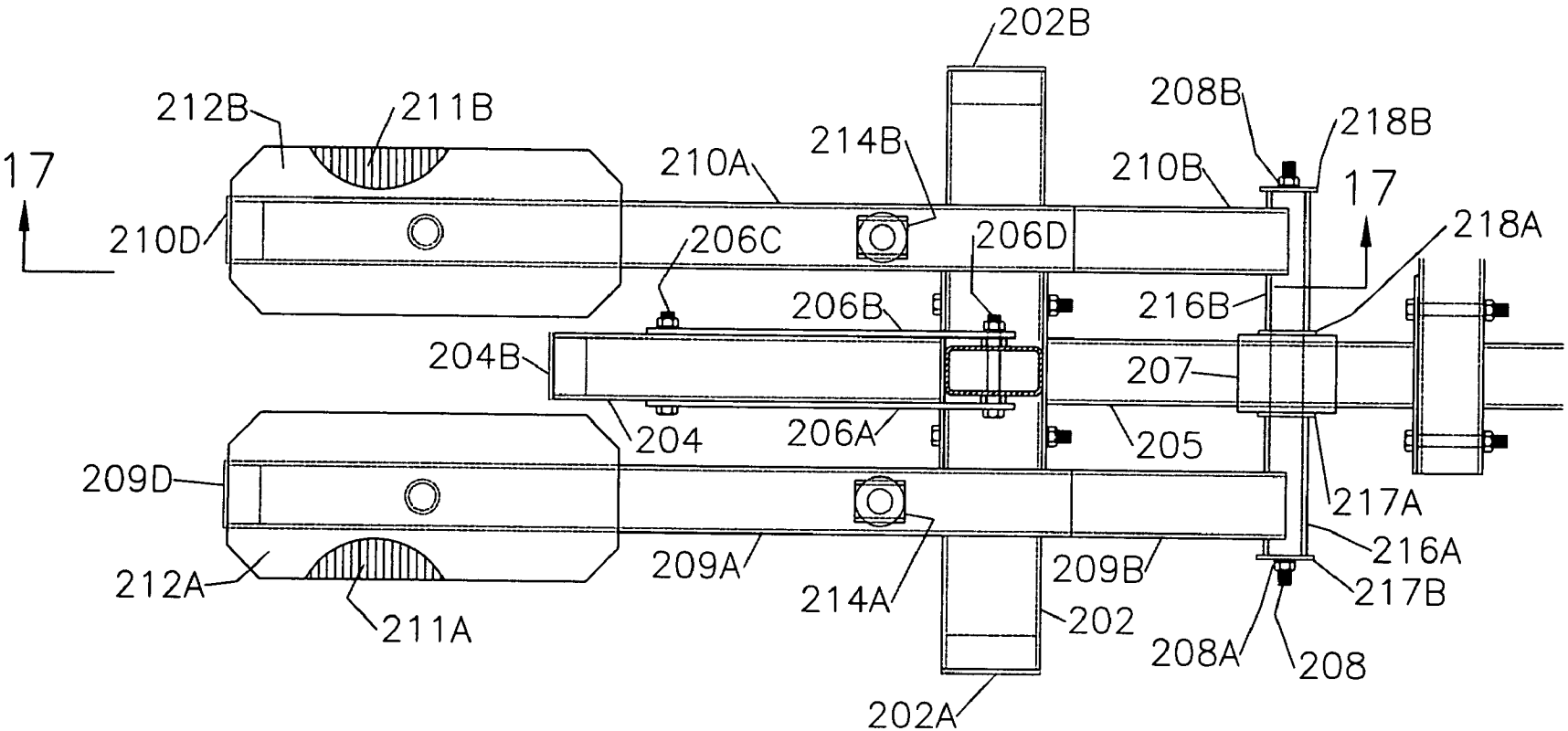
FIG. 16 shows sectional top view of the cardiovascular workout unit.
Figure 17:
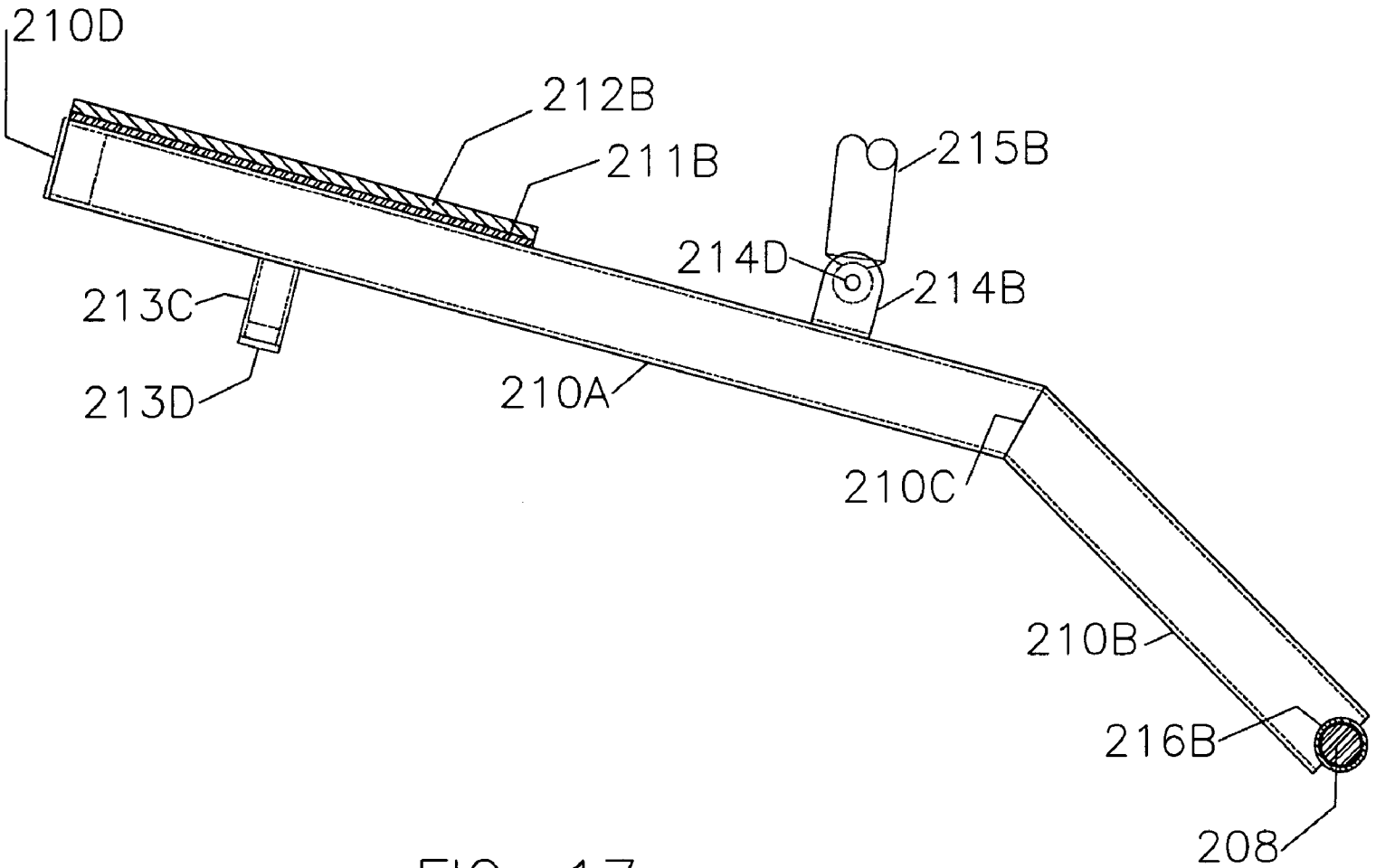
FIG. 17 shows sectional view of left stepper of the cardiovascular workout unit.

With reference to FIGS. 13, 15 and 15A, base support comprises of two horizontal tubes 204 and 205 oppositely disposed on either side of tube 202. Tube 204 has a rectangular connector plate 204A affixed to its distal end, a bushing 204B at its proximal end and a transverse through hole 204C close to its proximal end. Tube 205 has rectangular connector plates 205A and 205B affixed to its proximal and distal ends respectively. Each of the connector plates 204A and 205A has a pair of openings which match in size and location the pair of holes 202C in tube 202 (FIG. 14). A U-shaped bent plate 207 having oppositely disposed parallel openings adjacent its base is affixed upside down to tube 202 close to the distal end of tube 202. A solid round pivot bar 208 having both its ends machined and threaded is inserted in the hole of bent plate 207 and affixed in place extending outwards there from equally on both sides of bent plate 207. A pair of fasteners 202D connects the distal end of tube 204 and the proximal end of tube 205 to tube 202 at holes 202C. A pair of fasteners 205C connects the distal end of tube 205 to the distal end of tube 23 of upper body workout unit 20 at holes 23C. It is at this location that the upper body workout unit 20 and unit 200 are connected to each other. Flat bracing bars 206A and 206B having an opening adjacent their ends are oppositely disposed on either side of tubes 201 and 204 and connected to tube 204 using fastener 206C in hole 204C and to tube 201 using fastener 206D in hole 201C. Spacers 206E and 206F are used with fastener 206D to make up for the difference in width between upright tube 201 and horizontal tube 204.

With reference to FIGS. 13, 14, 16 and 17, a right stepper is comprised of primary tube 209A affixed to secondary tube 209B at location 209C with a preferred angle of disposition between the tubes. Tube 209A has bushing 209D at its free end and a foot rest plate 211A affixed to its top side adjacent its free end. A non-skid pad 212A having same dimensional configuration as that of plate 211A is affixed to top of plate 211A. A short hollow cylinder 213A having bushing 213B at its one end is affixed at its opposite end to the underside of tube 209A close to the free end of tube 209A extending downwards there from. A U-shaped bent plate 214A is affixed to the top side of tube 209A adjacent location 209C extending upwards there from and having oppositely disposed parallel openings. Tube 209B has a pipe sleeve 216A affixed to its free end. A left stepper is comprised of primary tube 210A affixed to secondary tube 210B at location 210C with a preferred angle of disposition between the tubes. Tube 210A has bushing 210D at its free end and a foot rest plate 211B affixed to its top side adjacent its free end. A non-skid pad 212B having same dimensional configuration as that of plate 211B is affixed to top of plate 211B. A short hollow cylinder 213C having bushing 213D at its one end is affixed at its opposite end to the underside of tube 210A close to the free end of tube 210A extending downwards there from. A U-shaped bent plate 214B is affixed to the top side of tube 210A adjacent location 210C extending upwards there from and having oppositely disposed parallel openings. Tube 210B has a pipe sleeve 216B affixed to its free end. To mount the right stepper on pivot bar 208, washer 217A is installed first followed by installation of right stepper by way of pipe sleeve 216A. Then second washer 217B and locknut 208A are installed successively to complete the connection. To mount the left stepper on pivot bar 208, washer 218A is installed first on pivot bar 208 followed by installation of left stepper by way of pipe sleeve 216B. Then second washer 218B and locknut 208B are installed successively to complete the connection.

With reference to FIGS. 13, and 14, a hollow cylinder 219 having bushings 219A and 219B at its proximal and distal ends respectively is inserted in hole 201B of tube 201 and affixed in place extending outwards there from equally on both sides of tube 201. A pair of oppositely disposed parallel plates 220A and 220B having oppositely disposed parallel openings are affixed to cylinder 219 adjacent its proximal ends. A second pair of oppositely disposed parallel plates 221A and 221B having oppositely disposed parallel openings are affixed to cylinder 219 adjacent its distal end. Hydraulic cylinder 215A is connected at its top end to plates 220A and 220B using fastener 222A and at its bottom end to bent plate 214A using fastener 214C. Hydraulic cylinder 215B is connected at its top end to plates 221A and 221B using fastener 222B and at its bottom end to bent plate 214B using fastener 214D.

Hollow cylinder handle 223 with bushings 223A and 223B at its either end is bent at two places with a preferred angle of disposition and affixed to top end of upright tube 224 at its mid-point location 223C with a preferred angle of disposition to the vertical plane as shown in FIG. 13. Bent plate 225 having a pair oppositely disposed openings which match in size and location holes 201A in tube 201 is affixed to bottom end of tube 224 extending downwards there from. A set of two fasteners 226 is used to connect bent plate 225 to tube 201 at holes 201A.

It is to be noted that the specific embodiments described in detail in the specification relevant to the drawings are what this inventor prefers. It is to be understood that many possibilities exist for substitutions of the specific embodiments and that such substitutions for as long as they represent the applications of the principles of the multi-party multi-purpose fitness machine shall be within the scope and legal equivalents as can further be determined from the claims.

The multi-party multi-purpose fitness machine 10 has capabilities for over thirty different types of exercises for building and toning various muscles of the body from the neck all the way down to the legs. The upper body workout unit 20 is used to develop the arm muscles, muscles of the neck, upper back, lower back, shoulders and the chest. The leg curl/extension workout unit 80 is used to build and tone the leg muscles specifically the quadriceps, the hamstrings and the muscles lying on the front of the lower legs. Additionally, unit 80 can be used to perform arm curl exercises to strengthen the arm muscles. The leg press unit 100 is used to develop the leg muscles specifically the quadriceps, the calves, the muscles lying on the front of the lower legs and the two muscles that connect part of the lower spine and hip bone to the top of the thigh. In this inventor's humble opinion that the most important exercise is the one that involves the heart. One of the exercises that has been determined to raise heart rate faster and excite the heart the most is stair climbing. The purpose of unit 200 is basically to simulate stair climbing for intense cardiovascular workout benefiting the heart. Additionally, unit 200 is used to develop the leg muscles specifically the quadriceps, the calves, the muscles lying on the front of the lower legs, the two muscles which connect part of the lower spine and hip bone to the top of the thigh and most importantly the gluteus maximus, the muscles of the buttock. For firming up the rear end, unit 200 is as good as one can get.

For all its simplicity, the multi-party multi-purpose fitness machine 10 packs a punch in terms of exercises one can perform on it and the number of users who can use it simultaneously. This fitness machine can accommodate at a minimum three users to exercise on it simultaneously to build and tone various muscles of their bodies. A maximum of five users can work on it simultaneously. The fitness machine has flexibility built into it for users to readily adjust the force application levers and the positions of the resistance mechanisms to suit the specific stature of any user and the type of exercise desired. This fitness machine has built-in stepper for the purpose of performing cardiovascular exercises to benefit the heart. The design of the machine has been simplified to eliminate complexities in manufacturing, set-up and maintenance. One of the benefits of this simplified design is the machine's capability to be collapsible when it is not operational.

In conclusion, there are all types of fitness machines in existence for any type of exercise desired. However, the goal of this invention is not to add one more, but to create a uniquely built affordable and efficient fitness machine that offers the most variety of exercises benefiting the entire human body for the least floor space and headroom requirements and the maximum number of simultaneous users and the least complexity in its ease of use, manufacturability, set-up and maintenance. It is this inventor's humble opinion that the multi-party multi-purpose fitness machine is it.

What is claimed is:

1. A multi-party, multi-purpose and collapsible fitness machine comprising: means for exercising the upper body; means for exercising for a leg curl/extension workout; means for exercising for a leg press workout; means for cardiovascular exercising; and said means for exercising cooperatively operating enabling up to five users to simultaneously exercise and strengthen various muscles.

2. The fitness machine of claim 1 wherein said means for exercising the upper body comprises:

a. a support base including a bottom horizontal tube having two parallel transverse through holes centered on its lengthwise center location, a left horizontal tube with a bushing at each end and two parallel transverse through holes adjacent its proximal end transversely affixed adjacent its distal end to one end of the bottom horizontal tube, a right horizontal tube with a bushing at each end and two parallel transverse through holes adjacent its proximal and distal ends oppositely disposed parallel to the left horizontal tube and transversely affixed adjacent its distal end to the opposite end of the bottom horizontal tube and with said holes adjacent the distal end of said tube being centered on the joint of fixity with the bottom horizontal tube;

b. a rear support frame including a top horizontal tube having two parallel transverse through holes centered on its lengthwise center location, a left upright tube with a bushing at its top end, a single transverse through hole adjacent its top end and two parallel transverse through holes adjacent its bottom end transversely affixed adjacent its top end to one end of the top horizontal tube and with said hole adjacent the top end of said tube being aligned with the horizontal axis of the top horizontal tube and with the bottom end of said tube disposed perpendicularly on top of the proximal end of the left horizontal tube of the support base, a right upright tube with a bushing at its top end, a single transverse through hole adjacent its top end and two parallel transverse through holes adjacent its bottom end oppositely disposed parallel to the left upright tube and transversely affixed adjacent its top end to the opposite end of the top horizontal tube and with said hole adjacent the top end of said tube being aligned with the horizontal axis of the top horizontal tube and with the bottom end of said tube disposed perpendicularly on top of the proximal end of the right horizontal tube of the support base;

c. a seat frame including a longitudinal tube having an elongated plate with oppositely disposed openings affixed to its proximal end, a bushing at its distal end, a transverse through hole adjacent its distal end, a second transverse through hole adjacent the first hole and a third transverse through hole adjacent its lengthwise center location extended over and affixed on its underside in the proximity of its distal end to top end of a center upright tube and which center upright tube has two parallel transverse through holes adjacent its bottom end, L-shaped bent plate affixed to its outward face and with the bottom end of said tube being disposed perpendicularly on top of the bottom horizontal tube of the support base at the lengthwise center location of said tube;

d. base connector plates including two identical left triangular connector plates oppositely disposed parallel to each other on either side of the proximal end of the left horizontal tube of the support base with each of said plates having four openings and with two of the openings adjacent bases of said plates matching in size and aligned with the through holes adjacent the proximal end of the left horizontal tube of the support base and with the remaining two openings adjacent top ends of said plates matching in size and aligned with the through holes adjacent the bottom end of the left upright tube of the rear support frame, two identical right triangular connector plates oppositely disposed parallel to each other on either side of the proximal end of the right horizontal tube of the support base with each of said plates having four openings and with two of the openings adjacent bases of said plates matching in size and aligned with the through holes adjacent the proximal end of the right horizontal tube of the support base and with the remaining two openings adjacent top ends of said plates matching in size and aligned with the through holes adjacent the bottom end of the right upright tube of the rear support frame, two identical center triangular connector plates oppositely disposed parallel to each other on either side of the lengthwise center location of the bottom horizontal tube of the support base with each of said plates having four openings and with two of the openings adjacent bottom bases of said plates matching in size and aligned with the through holes in said tube of the support base and with the remaining two openings adjacent top ends of said plates matching in size and aligned with the through holes adjacent the bottom end of the center upright tube of the seat frame;

e. support base fasteners including a set of four left fasteners with two of the fasteners affixing the bottom portion of the two identical left triangular connector plates to the proximal end of the left horizontal tube of the support base and the remaining two fasteners affixing the top portion of said plates to the bottom end of the left upright tube of the rear support frame, a set of four right fasteners with two of the fasteners affixing the bottom portion of the two identical right triangular connector plates to the proximal end of the right horizontal tube of the support base and the remaining two fasteners affixing the top portion of said plates to the bottom end of the right upright tube of the rear support frame; a set of four center fasteners with two of the fasteners affixing the bottom portion of the center triangular connector plates to the horizontal tube of the support base at the lengthwise center location of said tube and the remaining two fasteners affixing the top portion of said plates to the bottom end of the center upright tube of the seat frame;

f. seat frame fasteners comprising a set of two fasteners connecting the proximal end of the longitudinal tube of the seat frame to the top horizontal tube of the rear support frame at the lengthwise center location of said tube;

g. a seat comprising a seat base of uniform width, a seat cushion and a seat cover, which base, cushion and cover are supported on two elongated plates each having oppositely disposed openings and which plates are affixed to top surface of the longitudinal tube of the seat frame adjacent said tube's proximal and distal ends extending outwards there from equally on both sides of said tube;

h. a sleeve comprising a short hollow cylinder having a length equal to width of the longitudinal tube of the seat frame inserted in the through hole adjacent the distal end of said tube and affixed in place;

i. longitudinal bracing including a flat left bracing bar having an opening adjacent its either end affixed with self-taping fasteners to the left upright tube of the rear support frame and to the left horizontal tube of the support base at a preferred angle of disposition, a flat right bracing bar having an opening adjacent its either end oppositely disposed parallel to the left bracing bar and affixed with self-taping fasteners to the right upright tube of the rear support frame and to the right horizontal tube of the support base;

j. lateral bracing including a flat left bracing bar affixed to the left upright tube and to the top horizontal tube of the rear support frame at a preferred angle of disposition, a flat right bracing bar oppositely disposed to the left bracing bar and affixed to the right upright tube and to the top horizontal tube of the rear support frame;

k. pivot bars including a left round pivot bar having its distal end machined and threaded inserted at its proximal end in the through hole adjacent the top end of the left upright tube of the rear support frame and affixed to said tube extending outwards there from, a right round pivot bar having its distal end machined and threaded inserted at its proximal end in the through hole adjacent the top end of the right upright tube of the rear support frame and affixed to said tube extending outwards there from;

l. pivot bushings including a load bearing left cylindrical bushing inserted over the left round pivot bar, a load bearing right cylindrical bushing inserted over the right round pivot bar;

m. pivot frames including a left upright tube having a bushing at its bottom end, a transverse through hole adjacent its top end and a large transverse through hole at a location a third of its lengthwise distance up from the bottom end, a left horizontal tube having a bushing at its distal end transversely affixed at its proximal end to the left upright tube adjacent the bottom end of said tube extending outwards there from, a left hollow cylinder having a bushing at its distal end transversely affixed at its proximal end to the left horizontal tube extending outwards there from, a right upright tube having a bushing at its bottom end, a transverse through hole adjacent its top end and a large transverse through hole at a location a third of its lengthwise distance up from the bottom end, a right horizontal tube having a bushing at its distal end transversely affixed at its proximal end to the right upright tube adjacent the bottom end of said tube extending outwards there from, a right hollow cylinder having a bushing at its distal end transversely affixed at its proximal end to the left horizontal tube extending outwards there from;

n. pivot sleeves including a short left hollow cylinder inserted into the large through hole of the left upright tube of the pivot frames and affixed in place, a short right hollow cylinder inserted into the large through hole of the right upright tube of the pivot frames and affixed in place;

o. tubular bushings including a short left tubular bushing with a lip at its top end and a transverse through hole adjacent its top end inserted at its bottom end into the top end of the left upright tube of the pivot frames with the through holes adjacent top ends of said tubes being aligned, a short right tubular bushing with a lip at its top end and a transverse through hole adjacent its top end inserted at its bottom end into the top end of the right upright tube of the pivot frames with the through holes adjacent top ends of said tubes being aligned;

p. stop bars including a left flat stop bar affixed at its one end to the left upright tube of the pivot frames adjacent the left pivot sleeve extending inwards there from, a right flat stop bar affixed at its one end to the right upright tube of the pivot frames adjacent the right pivot sleeve extending inwards there from;

q. pivot joint connectors including a set of two left washers, two right washers, one left locknut and one right locknut with one each of the left and right washers installed first over the left and right pivot bars respectively and the remaining left and right washers and locknuts installed successively after installation of the respective left and right load bearing bushings and the respective left and right upright tubes of the pivot frames;

r. telescoping frames including a right upright tube having a bushing at its top end and a set of equally spaced parallel transverse through holes along its length, a long horizontal hollow cylinder having a bushing at its distal end transversely affixed at its proximal end to the left upright tube adjacent the top end of said tube, a long cylindrical cushion installed over the long hollow cylinder adjacent the distal end of said cylinder, a left upright tube having a bushing at its top end and a set of equally spaced parallel transverse through holes along its length, a short horizontal hollow cylinder having a bushing at its distal end transversely affixed at its proximal end to the right upright tube adjacent the top end of said tube;

s. lock pins including a left lock pin to interlock the left upright tube of the telescoping frames with the left upright tube of the pivot frames and which lock pin is installed after aligning any of the parallel through holes in the left upright tube of the telescoping frames with the one hole adjacent the top end of the left upright tube of the pivot frames, a right lock pin to interlock the right upright tube of the telescoping frames with the right upright tube of the pivot frames and which lock pin is installed after aligning any of the parallel through holes in the right upright tube of the telescoping frames with the one hole adjacent the top end of the right upright tube of the pivot frames;

t. a leg cushion comprising a hollow cylinder with a bushing at each end inserted in the second transverse through hole of the longitudinal tube of the seat frame and affixed in place extending outwards there from equally on both sides of said tube and a pair of oppositely disposed cylindrical cushions installed over the hollow cylinder adjacent its either end;

u. a removable hollow cylinder handle with a bushing at each end installed as needed in the third through hole of the longitudinal tube of the seat frame;

v. a set of free weights mounted on the left and right hollow cylinders of the left and right pivot frames respectively.

3. The exercise apparatus of claim 1 wherein said means for exercising for a leg curl/extension workout comprises:

a. a resistance mechanism including an upright tube with a bushing at its bottom end, a single transverse through hole adjacent its bottom end, two oppositely disposed parallel transverse through holes adjacent its top end, a flat cap plate affixed to its top end, a pair of oppositely disposed parallel plates affixed to top of the cap plate extending upwards there from and having oppositely disposed parallel openings, a short hollow cylinder with a bushing at its distal end transversely affixed at its proximal end to the upright tube adjacent the top end of said tube extending outwards there from, a second long hollow cylinder with a bushing at its distal end disposed opposite the short hollow cylinder and transversely affixed at its proximal end to the upright tube adjacent the lengthwise center location of said tube extending outwards there from, a set of free weights supported on the long hollow cylinder, a third hollow cylinder with a bushing at each end inserted in the transverse through hole adjacent the bottom end of the upright tube and affixed in place extending outwards there from equally on either side of said tube and a pair of oppositely disposed cylindrical cushions installed over said cylinder adjacent its either end;

b. a collapsible leg curl lever including a horizontal tube with a bushing at its distal end, a transverse through hole adjacent its distal end, and a second transverse through hole at a location a fourth of the lengthwise distance in from the distal end, a U-shaped bent plate affixed to its proximal end extending outwards there from and having two pairs of oppositely disposed parallel openings, an upright tube having a transverse through hole adjacent its bottom end, a second larger transverse through hole adjacent its top end and a pair of oppositely disposed parallel plates affixed to its sides adjacent its bottom end extending downwards there from and having a pair of oppositely disposed openings, a long hollow cylinder with a bushing at each end inserted in the larger transverse through hole adjacent the top end of the upright tube and affixed in place extending outwards there from equally on either side of said tube, a pair of oppositely disposed cylindrical cushions installed over the long hollow cylinder adjacent its either end, a pair of oppositely disposed parallel flat linkage bars each having an opening adjacent its distal and proximal ends, a set of two fasteners and four spacers with two of the spacers installed on either side of the horizontal tube aligned with the second transverse through hole of said tube and with the openings at the proximal ends of the linkage bars and with the remaining two spacers installed on either side of the upright tube aligned with the transverse through hole of said tube and with the openings at the distal ends of said bars and with each fastener installed in the respective aligned holes and openings to affix said bars to the horizontal and upright tubes, a lock pin installed to interlock the bottom end of the upright tube to the distal end of the horizontal tube after aligning the transverse through hole adjacent the distal end of the horizontal tube with the openings in the plates adjacent the bottom ends of the upright tube, c. a fastener to connect the leg curl/extension unit to the upper body workout unit and which fastener is installed after aligning the openings in the pair of oppositely disposed parallel plates atop the cap plate of the resistance mechanism of the leg curl/extension workout unit with the pipe sleeve affixed in the second hole of the longitudinal tube of the seat frame of the upper body workout unit.

4. The fitness machine of claim 1 wherein said means for exercising for a leg press workout comprises:

a. an exterior support frame including an upright tube with a bushing at its top end, two oppositely disposed parallel transverse through holes adjacent its lengthwise center location, a pair of oppositely disposed parallel plates affixed to its sides adjacent its top end extending outwards there from and having a pair of oppositely disposed openings, a pair of U-shaped hollow cylinders with bushings at their distal ends affixed at their proximal ends to the sides of the parallel plates adjacent the top end of the upright tube, a bottom horizontal tube affixed to the bottom end of the upright tube at its lengthwise center location and which horizontal tube has a bushing at each end, a roller/glider affixed to its underside adjacent its either end and two oppositely disposed parallel transverse through holes centered on its lengthwise center location;

b. an interior support frame including an upright tube with L-shaped bent plate affixed to its outward face extending outwards there from and having an opening at its free end, a U-shaped bent plate affixed to its top end extending upwards there from and having two pairs of oppositely disposed parallel openings, a bottom horizontal tube affixed to the bottom end of the upright tube at its lengthwise center location and which horizontal tube has a bushing at each end, a roller/glider affixed to its underside adjacent its either end and two oppositely disposed parallel transverse through holes centered on its lengthwise center location;

c. a bottom strut including a bottom strut tube with elongated plate affixed to its proximal and distal ends and which plates have oppositely disposed openings matching in size and being aligned with the transverse through holes in the bottom horizontal tubes of the exterior and interior support frames, a short upright tube with a transverse through hole adjacent its distal end affixed at its proximal end to the top surface of the bottom strut tube extending upwards there from, a hollow cylinder with a bushing at each end inserted in the transverse through hole of the short upright tube and affixed in place extending outwards there from equally on either side of said tube and a pair of oppositely disposed cylindrical cushions installed adjacent either end of the hollow cylinder;

d. a top strut including a top strut tube with a bushing at its distal end, a glider disc affixed to its top surface adjacent its distal end, a pair of oppositely disposed parallel transverse through holes adjacent its distal end and which holes match in size and are aligned with the openings in the bent plate at the top end of the upright tube of the interior frame, a U-shaped bent plate affixed to its proximal end extending outwards there from and having two pairs of oppositely disposed parallel openings and which openings match in size and are aligned with the transverse through holes adjacent the lengthwise center location of the upright tube of the exterior support frame, a pair of oppositely disposed parallel guide plates affixed to its either side adjacent its proximal end and a second pair of oppositely disposed parallel guide plates affixed to its either side adjacent its lengthwise center location;

e. bottom strut connectors including a set of two left fasteners affixing the proximal end of the bottom strut tube to the bottom horizontal tube of the exterior support frame and a set of two right fasteners affixing the distal end of the bottom strut tube to the bottom horizontal tube of the interior support frame;

f. top strut connectors including a set of two left fasteners affixing the bent plate at the proximal end of the top strut tube to the upright tube of the exterior support frame and a set of two right fasteners affixing the distal end of the top strut tube to the bent plate atop the upright tube of the interior support frame;

g. a seat frame including a longitudinal tube with a bushing at its proximal end, a set of equally spaced parallel transverse through holes adjacent its lengthwise center location, a single transverse through hole close to its distal end, a glider disc affixed to its underside adjacent its proximal end, and an elongated plate having a pair of oppositely disposed openings affixed to its distal end and which plate is affixed to the top horizontal tube of the rear support frame of the upper body workout unit with the same set of two fasteners connecting the longitudinal and the top horizontal tubes of the upper body workout unit at the lengthwise center location of the top horizontal tube;

h. a seat comprising a seat base of variable width, a seat cushion and a seat cover, which base, cushion and cover are supported on three elongated plates each having oppositely disposed openings and which plates are affixed to the top surface of the longitudinal tube extending outwards there from equally on either side of said tube and with the first plate located adjacent the proximal end, the second plate located adjacent the lengthwise center location and the third plate located adjacent the distal end of said tube;

i. a lock brace mechanism including an angle member with a hole adjacent its proximal end and a U-shaped bent plate affixed to its distal end extending upwards there from and having a pair of oppositely disposed openings, a fastener to affix the proximal end of the angle member to the L-shaped bent plate on the outward face of the upright tube of the interior support frame, and a lock pin installed to interlock the lock brace mechanism with the longitudinal tube of the seat frame after aligning any of the parallel transverse through holes in the longitudinal tube with the pair of oppositely disposed openings in the bent plate atop the angle member;

j. a resistance mechanism including an upright tube with a bushing at its bottom end, a flat cap plate affixed to its top end, a pair of oppositely disposed parallel plates affixed to top of the cap plate extending upwards there from and having a pair of oppositely disposed openings, a perpendicular transverse through hole adjacent a location a third of the lengthwise distance of the upright tube up from the bottom end, a long hollow cylinder with a bushing at each end inserted in the perpendicular hole and affixed in place extending outwards there from on either side of the upright tube unevenly, a set of free weights supported on the hollow cylinder;

k. a lever system including a pair of oppositely disposed horizontal tubes affixed at their proximal ends to either side of the upright tube of the resistance mechanism adjacent its bottom end; another pair of oppositely disposed parallel horizontal tubes each having a bushing at one end affixed transversely at the opposite end to the distal ends of the first pair of oppositely disposed horizontal tubes, a pair of oppositely disposed flat plates each affixed to the outward face of the second pair of oppositely disposed horizontal tubes adjacent the free ends of said tubes and with each plate having an opening adjacent its free end and a pair of oppositely disposed pedals inserted at their connection ends in said openings of said plates and affixed in place.

5. The exercise apparatus of claim 1 wherein said means for cardio-vascular exercising comprises:

a. a support base including a left horizontal tube with a bushing at its proximal end, a transverse through hole adjacent a location a third of its lengthwise distance in from the proximal end and an elongated plate having a pair of oppositely disposed openings affixed to its distal end, a right horizontal tube with elongated plate having oppositely disposed openings affixed to its proximal and distal ends, an inverted U-shaped bent plate affixed to the right horizontal tube at a location a third of its lengthwise distance in from the distal end of said tube and which bent plate has a pair of oppositely disposed openings adjacent its inverted base, a round pivot bar having its either end machined and threaded inserted in said openings of said bent plate and affixed in place extending outwards there from equally on either side of the bent plate;

b. a vertical support frame including an upright tube having two oppositely disposed parallel transverse through holes adjacent its top end, a single large transverse through hole adjacent and centered on the first two holes, a third transverse through hole adjacent a location a fourth of said tube's lengthwise distance up from the bottom end, a hollow cylinder with a bushing at each end inserted in the large transverse through hole and affixed in place extending outwards there from equally on either side of the upright tube, a pair of oppositely disposed parallel connector plates affixed to the hollow cylinder adjacent each end extending downwards there from and having a pair of oppositely disposed openings, a bottom horizontal tube with a bushing at each end affixed on its top side to the bottom end of the upright tube at its lengthwise center location and with said tube having two oppositely disposed parallel transverse through holes centered on its lengthwise center location;

c. base connectors including a set of two fasteners affixing the distal end of the left horizontal tube and the proximal end of the right horizontal tube to the lengthwise center location of the bottom horizontal tube of the vertical support frame, a second set of two fasteners affixing the distal end of the right horizontal tube to the distal end of the right horizontal tube of the support base of the upper body workout unit;

d. bracing system including a pair of parallel flat bracing bars oppositely disposed on either side of the left horizontal tube and the upright tube of the vertical support frame with each bracing bar having an opening adjacent its proximal and distal ends and which openings match in size and are aligned with the transverse through hole of the left horizontal tube and the third transverse through hole of the upright tube, a set of two fasteners affixing the proximal ends of the flat bracing bars to the left horizontal tube and a second set of two fasteners and two spacers affixing the distal ends of said bars to the upright tube;

e. a left stepper including a left primary tube with a bushing at its proximal end affixed at its distal end to a left secondary tube with a preferred angle of disposition and which secondary tube has a pipe sleeve affixed to its opposite end, a short hollow cylinder with a bushing at one end affixed to the underside of the left primary tube adjacent its proximal end extending downwards there from, a flat foot rest plate affixed to the top surface of the left primary tube adjacent its proximal end, a flat non-slip pad affixed to the top of the flat plate, a bent plate affixed to the top surface of the left primary tube adjacent its point of fixity with the left secondary tube;

f. a right stepper including a right primary tube with a bushing at its proximal end affixed at its distal end to a right secondary tube with a preferred angle of disposition and which secondary tube has a pipe sleeve affixed to its opposite end, a short hollow cylinder with a bushing at one end affixed to the underside of the right primary tube adjacent its proximal end extending downwards there from, a flat foot rest plate affixed to the top surface of the right primary tube adjacent its proximal end, a flat non-slip pad affixed to the top of the flat plate, a bent plate affixed to the top surface of the right primary tube adjacent its point of fixity with the right secondary tube;

g. means for generating dynamic resistance including left and right hydraulic cylinders affixed at their bottom ends to the bent plates of the respective left and right steppers and affixed at their top ends to the parallel connector plates adjacent each end of the hollow cylinder of the vertical support frame;

h. a stepper handle including an upright tube with a U-shaped bent plate affixed to its bottom end extending downwards there from and having two pairs of oppositely disposed parallel openings and which openings match in size and are aligned with the transverse through holes adjacent the top end of the upright tube of the vertical support frame, a hollow cylinder having a bushing at each end bent with a preferred angle of disposition at two locations a third of the lengthwise distance from either end and affixed at its lengthwise center location to top of the upright tube, a set of two fasteners affixing the bent plate to top of the upright tube of the vertical support frame.

* * * * *